US009665056B2

(12) United States Patent
Shirasaki et al.

(10) Patent No.: US 9,665,056 B2
(45) Date of Patent: May 30, 2017

(54) REFERENCE PLATE MOVING MECHANISM FOR POST-PROCESSING DEVICE

(71) Applicant: KYOCERA Document Solutions Inc., Osaka (JP)

(72) Inventors: Seiichi Shirasaki, Osaka (JP); Takeshi Matsuo, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 147 days.

(21) Appl. No.: 14/715,867

(22) Filed: May 19, 2015

(65) Prior Publication Data

US 2015/0338814 A1 Nov. 26, 2015

(30) Foreign Application Priority Data

May 23, 2014 (JP) ..... 2014-106951

(51) Int. Cl.

| | |
|---|---|
| ***B65H 37/04*** | (2006.01) |
| ***G03G 15/00*** | (2006.01) |
| ***B42B 4/00*** | (2006.01) |
| ***B65H 31/34*** | (2006.01) |
| ***B65H 31/02*** | (2006.01) |

(52) U.S. Cl.

CPC ..... *G03G 15/6582* (2013.01); *B42B 4/00* (2013.01); *B65H 31/02* (2013.01); *B65H 31/34* (2013.01); *B65H 37/04* (2013.01); *G03G 15/6538* (2013.01); *B65H 2405/1134* (2013.01); *B65H 2408/122* (2013.01); *B65H 2601/10* (2013.01); *B65H 2601/26* (2013.01); *B65H 2801/27* (2013.01); *G03G 2215/00827* (2013.01)

(58) Field of Classification Search

CPC ..... B42B 4/00; B65H 31/02; B65H 31/34; B65H 37/04; G03G 15/6538

USPC ..... 270/58.12

See application file for complete search history.

(56) References Cited

U.S. PATENT DOCUMENTS

| | | | | |
|---|---|---|---|---|
| 5,639,078 | A * | 6/1997 | Mandel | B42C 1/12 270/58.12 |
| 7,389,980 | B2 * | 6/2008 | Kushida | B65H 9/06 270/58.12 |
| 7,597,312 | B2 * | 10/2009 | Nishioka | B42C 1/12 270/58.07 |
| 7,988,139 | B2 * | 8/2011 | Matsuura | B65H 31/3081 270/58.07 |

(Continued)

FOREIGN PATENT DOCUMENTS

| | | |
|---|---|---|
| JP | 2009-263026 | 11/2009 |
| JP | 2013-230893 | 11/2013 |

*Primary Examiner* — Patrick Mackey

(74) *Attorney, Agent, or Firm* — Wenderoth, Lind & Ponack, L.L.P.

(57) ABSTRACT

A staple processing device includes a staple tray, a staple unit, a rear reference plate, a front reference plate, and an interlocking mechanism. The staple unit performs a staple process on a plurality of sheets loaded on the staple tray. The staple unit is movable along the ends of the sheets in a sheet width direction. The rear reference plate and the front reference plate abut the ends of the plurality of sheets and aligns the plurality of sheets. The interlocking mechanism moves the rear reference plate and the front reference plate in the sheet width direction in interlock with the movement of the staple unit.

11 Claims, 18 Drawing Sheets

(56) References Cited

U.S. PATENT DOCUMENTS

| | | | | |
|---|---|---|---|---|
| 8,485,514 | B2 * | 7/2013 | Sugiyama | B65H 31/3081 270/58.09 |
| 8,496,239 | B2 * | 7/2013 | Furuhashi | B42C 1/125 270/58.09 |
| 8,702,087 | B2 * | 4/2014 | Furuhashi | B65H 31/38 270/58.12 |
| 8,770,569 | B2 * | 7/2014 | Furuhashi | B65H 37/04 270/58.09 |

* cited by examiner

REFERENCE PLATE MOVING MECHANISM FOR POST-PROCESSING DEVICE

CROSS-REFERENCE TO RELATED APPLICATION

This application is based upon and claims the benefit of priority from Japanese Patent Application No. 2014-106951 filed on May 23, 2014, the entire contents of which are incorporated herein by reference.

BACKGROUND

The technology of the present disclosure relates to a post-processing device that performs post-processing on a sheet and an image forming apparatus employing the same.

Conventionally, there has been known a post-processing device that sequentially performs post-processing on a plurality of sheets and then aligns and discharges the plurality of sheets when image-formed sheets are discharged to a paper discharge tray. The post-processing performed on the sheets includes a staple process. The post-processing device includes a processing tray and a loading tray. The staple process is performed on a plurality of sheets loaded on the processing tray, and then a sheet bundle is discharged to the loading tray. The post-processing device, for example, includes a width restraint member that restrains the positions of sheets in a width direction and a reference plate that aligns the rear ends of the sheets for the staple process. The reference plate moves to a restraint position according to a sheet size in interlock with a width aligning operation of the width restraint member. The width restraint member performs the width aligning operation whenever the processing tray receives sheets one by one.

SUMMARY

A post-processing device according to one aspect of the present disclosure includes a housing, a tray unit, a staple unit, a movement section, a reference plate, and an interlocking mechanism. On the tray unit, a plurality of sheets are carried toward a predetermined conveyance direction and are loaded. The staple unit is disposed to face the ends of front end sides of the sheets in the conveyance direction. The staple unit is movable along the ends in a sheet width direction perpendicular to the conveyance direction. The staple unit performs a staple process on the plurality of sheets. The movement section moves the staple unit in the sheet width direction. The reference plate abuts the ends of the plurality of sheets and aligns the plurality of sheets. The interlocking mechanism moves the reference plate in the sheet width direction in interlock with the movement of the staple unit.

DETAILED DESCRIPTION

Figure 1:
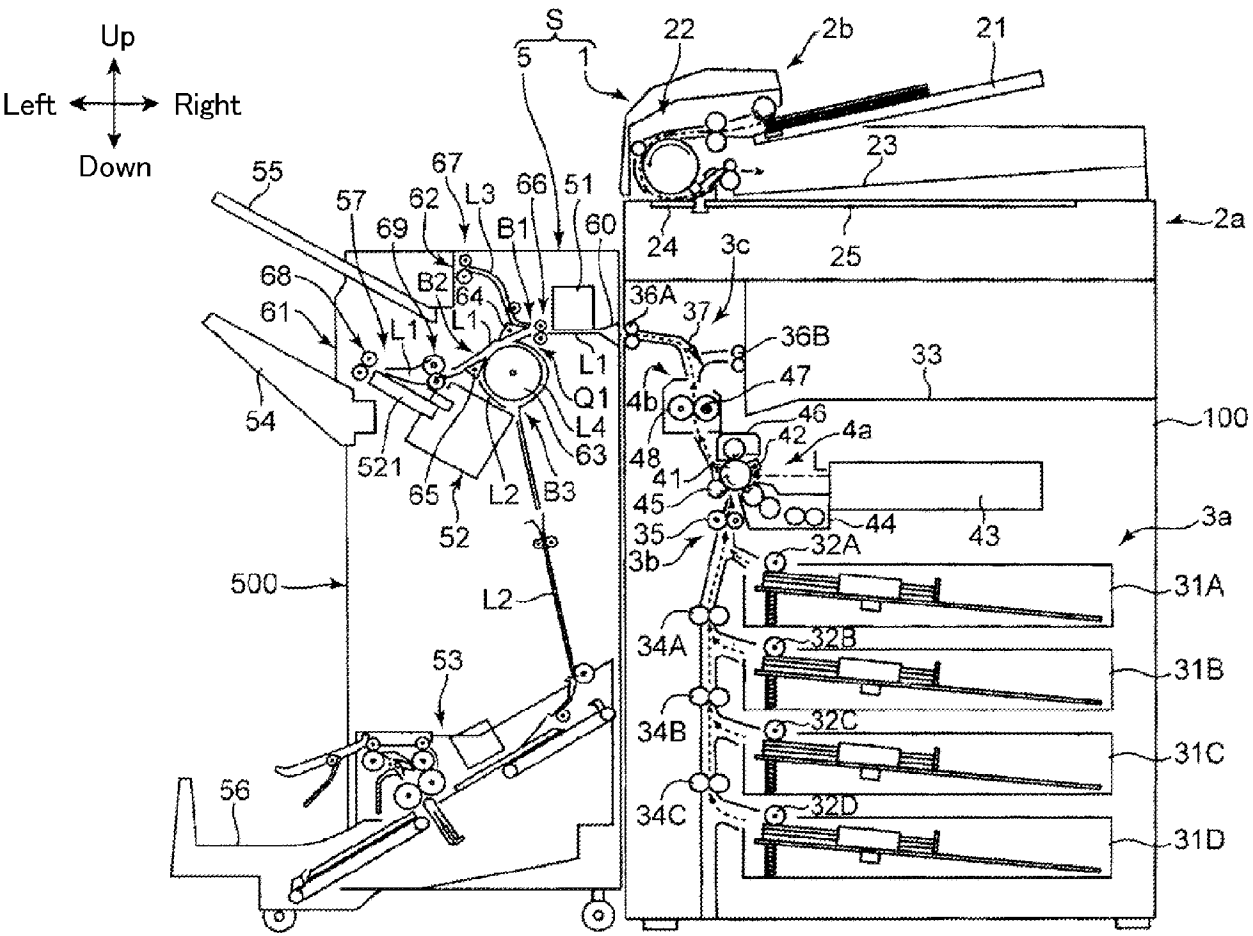
FIG. 1 is a sectional view schematically illustrating an internal structure of an image forming apparatus including a post-processing device according to an embodiment.

Hereinafter, an embodiment will now be described in detail with reference to the drawings. FIG. 1 is a sectional view schematically illustrating an internal structure of an image forming apparatus S including a post-processing device 5 and a body 1 according to an embodiment. Here, the body 1 of the image forming apparatus S indicates a so-called in-body paper discharge type monochrome copy machine. However, the body unit may be a color copy machine, a printer, a facsimile apparatus, or a multifunctional peripheral having functions thereof.

As illustrated in FIG. 1, the image forming apparatus S includes the body 1 that performs an image forming process on a sheet, and the post-processing device 5 provided with a post-processing unit disposed adjacent to the body 1 and performing predetermined post-processing on a sheet or a sheet group (a sheet bundle) subjected to the image forming process. The post-processing, for example, includes a punching process for perforating a binding hole in a sheet, a staple process for driving a staple needle into a sheet group, a center folding process for folding a sheet, an aligning process for performing a shift operation, a width aligning operation and the like on a sheet.

The body 1 includes a body housing 100, an image reading unit 2*a* disposed at an upper portion of the body housing 100, and an automatic document feeder (ADF) 2*b* disposed on an upper surface of the image reading unit 2*a*. The body housing 100 has a paper feeding unit 3*a*, a conveyance path 3*b*, an image forming unit 4*a*, a fixing unit 4*b*, and a sheet discharge unit 3*c* therein.

The automatic document feeder 2*b* automatically feeds a document sheet to be copied toward a predetermined document reading position (a position at which a first contact glass 24 has been assembled). On the other hand, when a user manually puts a document sheet at a predetermined document reading position (an arrangement position of a second contact glass 25), the automatic document feeder 2*b* is opened upward. The automatic document feeder 2*b* includes a document tray 21 on which the document sheet is put, a document conveying unit 22 that conveys the document sheet via an automatic document reading position, and a document discharge tray 23 to which a read document sheet is discharged.

The image reading unit 2*a* has a box-like housing structure, and a first contact glass 24 for reading of a document sheet automatically fed from the automatic document feeder 2*b* and a second contact glass 25 for reading of a document sheet manually put have been fitted on an upper surface of the image reading unit 2*a*. The image reading unit 2*a* optically reads an image of a document sheet.

The paper feeding unit 3*a* of the body housing 100 includes a plurality of cassettes 31 (as illustrated in FIG. 1, four cassettes in total 31A, 31B, 31C, and 31D from the top). Each cassette 31 includes a paper feeding roller 32 rotationally driven (in FIG. 1, four rollers in total 32A, 32B, 32C, and 32D from the top), and sends sheets to the conveyance path 3*b* one by one at the time of image formation.

The conveyance path 3*b* is a conveyance path for conveying sheets in the body housing 100 from the paper feeding unit 3*a* to an in-body discharge tray 33 or the post-processing device 5. The conveyance path 3*b* is provided with a guide plate for guiding sheets, a conveying roller pair 34 (in FIG. 1, three rollers in total 34A, 34B and 34C from the top) rotationally driven at the time of sheet conveyance, and a resist roller pair 35 for keeping a conveyed sheet waiting in front of the image forming unit 4*a* and sending the sheet in accordance with a transfer timing of a formed toner image.

The image forming unit 4*a* generates a toner image, and transfers the toner image onto a sheet, that is, forms an image on the sheet. The image forming unit 4*a* includes a photosensitive drum 41, and a charging device 42, an exposure device 43, a developing device 44, a transfer roller 45, and a cleaning device 46 disposed in the vicinity of the photosensitive drum 41.

The photosensitive drum 41 rotates around a shaft thereof and forms an electrostatic latent image and a toner image on the peripheral surface thereof. The charging device 42 uniformly electrifies the surface of the photosensitive drum 41. The exposure device 43 has an optical system instrument of a laser light source, a mirror, a lens and the like, and irradiates laser light L based on image data of a document image onto the peripheral surface of the photosensitive drum 41, thereby forming an electrostatic latent image. The developing device 44 supplies toner to the peripheral surface of the photosensitive drum 41 in order to develop the electrostatic latent image formed on the photosensitive drum 41. The transfer roller 45 forms a transfer nip portion together with the photosensitive drum 41, and receives a transfer bias applied thereto. A toner image on the photosensitive drum 41 is transferred to a sheet passing through the transfer nip portion. The cleaning device 46 has a cleaning roller and the like, and cleans the peripheral surface of the photosensitive drum 41 after the toner image transfer.

The fixing unit 4*b* fixes the toner image transferred to the sheet. The fixing unit 4*b* includes a heating roller 47 having a heating element therein and a pressing roller 48 brought into press-contact with the heating roller 47. When the sheet with the transferred toner image passes through a fixing nip formed by the heating roller 47 and the pressing roller 48, the toner is melt and heated, so that the toner image is fixed to the sheet. The sheet subjected to the fixing process is sent to the sheet discharge unit 3*c*.

The sheet discharge unit 3*c* has an external discharge roller pair 36A for sending an image-formed sheet in the direction of the post-processing device 5, and an internal discharge roller pair 36B for sending the image-formed sheet in the direction of the in-body discharge tray 33. Each of the discharge roller pair 36A and the discharge roller pair 36B is rotationally driven at the time of a discharge operation and discharges sheets to an exterior of the apparatus. Furthermore, the sheet discharge unit 3*c* has a switching lever 37 that switches a conveyance direction of a sheet paper.

The post-processing device 5 includes a post-processing device body 500 disposed adjacent to the body housing 100, and a post-processing unit disposed in the post-processing device body 500. In the present embodiment, as the post-processing unit, a punching device 51, a staple processing device 52, a center folding device 53, and an aligning unit 57 are provided. The punching device 51, the staple processing device 52, and the aligning unit 57 are accommodated in the vicinity of the upper portion of the post-processing device body 500, and the center folding device 53 is accommodated in the vicinity of the lower portion of the post-processing device body 500.

At a side of the post-processing device body 500, which faces the body housing 100, an inlet 60 for receiving sheets subjected to an image forming process to the inside of the body 500 is provided, and at a side (a left side) opposite to the side, a main outlet 61 and a sub-outlet 62 for discharging sheets from the body 500 are provided. In correspondence to these main outlet 61 and sub-outlet 62, a main discharge tray (a tray) and a sub-discharge tray 55 are mounted at the left side surface of the post-processing device body 500. In addition, the post-processing device body 500 is provided therein with a first conveyance path L1, a second conveyance path L2, a third conveyance path L3, a fourth conveyance path L4, a first merging portion Q1, a first branch portion B1, a second branch portion B2, a third branch portion B3, and a retreating drum 63.

The first conveyance path L1 is a conveyance path for conveying sheets carried from the inlet 60 to the main outlet 61. Sheets discharged from the main outlet 61 are discharged to the main discharge tray 54.

The third conveyance path L3 is formed to be branched from the first conveyance path L1 at the first branch portion B1. The third conveyance path L3 is a conveyance path from the first branch portion B1 to the sub-outlet 62. Sheets discharged from the sub-outlet 62 are discharged to the sub-discharge tray 55.

The second conveyance path L2 is formed to be branched from the first conveyance path L1 at the second branch portion B2. The second conveyance path L2 is a conveyance path extending to the center folding device 53 in a vertical direction. The fourth conveyance path L4 is a conveyance path which is branched from the second conveyance path L2 at the third branch portion B3, is curved around the retreating drum 63, and is merged into the first conveyance path L1 at the first merging portion Q1.

At the first branch portion B1, a first switching claw 64 is disposed. The first switching claw 64 switches a conveyance destination of a sheet conveyed along the first conveyance path L1 between the first conveyance path L1 as is and the third conveyance path L3. At the second branch portion B2, a second switching claw 65 is disposed. The second switching claw 65 switches the conveyance destination of the sheet between the first conveyance path L1 and the second conveyance path L2.

At a position adjacent to an upstream side of the first branch portion B1, a first conveying roller pair 66 is disposed. Furthermore, at a downstream end of the first conveyance path L1, a fourth conveying roller pair 68 is disposed in the vicinity of the main outlet 61. Moreover, at an upstream side of the first conveyance path L1 from the fourth conveying roller pair 68, a second conveying roller pair 69 is disposed. Sheets passing through the first conveyance path L1 are conveyed from the inlet 60 to the main outlet 61 and the main discharge tray 54 by these first conveying roller pair 66, second conveying roller pair 69, and fourth conveying roller pair 68.

At a downstream end of the third conveyance path L3, a third conveying roller pair 67 is disposed in the vicinity of the sub-outlet 62. Sheets conveyed along the third conveyance path L3 are discharged to the sub-discharge tray 55 by the third conveying roller pair 67.

The punching device 51 is disposed at an entrance side of the first conveyance path L1. The punching device 51 performs a punching process (a perforating process) for perforating a binding hole in sheets at a predetermined timing. The punching device 51 performs the punching process on the rear end sides of the sheets in the conveyance direction. When the punching process is performed, the sheets are temporarily stopped in the horizontal conveyance area.

The staple processing device 52 performs a staple process for driving a staple needle on a sheet group including a plurality of sheets. The staple process is a process for driving the staple needle into a corner or an end portion of the sheet group, a so-called end stitching process. When the staple process is performed, in the state in which a conveyance nip portion of the fourth conveying roller pair 68 has been released, a sheet is conveyed in the vicinity of the main outlet 61 along the first conveyance path L1 and is loaded on a staple tray 521. The corner or end portion of the sheet loaded on the staple tray 521 is entered into a staple unit 71 of the staple processing device 52. The sheet group subjected to the staple process is discharged to the main discharge tray 54 by the fourth conveying roller pair 68 with the restored conveyance nip portion.

The center folding device 53 performs center stitching for driving the saddle needle in the vicinity of the center of the sheet group and performs a center folding process of folding the sheet group at the center part thereof twice. A sheet to be subjected to the center folding process is introduced to the second conveyance path L2 from the first conveyance path L1 via the second branch portion B2, and is carried in the center folding device 53. The sheet group subjected to the center folding process is discharged to a center folding sheet discharge tray 56 provided at a lower portion of the post-processing device body 500. In addition, the center folding device 53 may also perform only the center folding process.

The aligning unit 57 performs an alignment operation, such as a shift operation for shifting a sheet or a sheet group in a sheet width direction perpendicular to a sheet conveyance direction and a width aligning operation for aligning an end of the sheet group. When the staple process is performed by the staple processing device 52, the aligning unit 57 performs the shift operation or the width aligning operation on the sheet group in order to decide a staple position. Furthermore, even though the staple process is not performed, the aligning unit 57 is also used when sheets are offset-discharged to the main discharge tray 54. The offset discharge means, for example, when a plurality of sets of copies are performed on one group of document sheet group including a plurality of sheets, an end position of the sheet group is shifted in a sheet width direction for stack in units of one set of copy sheet groups.

The main discharge tray 54 is a tray in which a sheet or a sheet group subjected to the staple process, the shift operation, and the width aligning operation and discharged from the main outlet 61 by the fourth conveying roller pair 68 is stacked. The main discharge tray 54 is configured to sequentially fall down from the uppermost position according to an increase of a bundle of discharged sheets, to rise when the bundle of the sheets is removed from the main discharge tray 54, and to return a reference position. The sub-discharge tray 55 is a tray in which sheets discharged from the sub-outlet 62 by the third conveying roller pair 67 are stacked. In the sub-discharge tray 55, sheets discharged without particularly the post-processing in the post-processing device 5 or sheets subjected to only the punching process are mainly stacked.

The retreating drum 63 has a peripheral surface and is rotationally driven in a predetermined rotation direction. In the case in which the staple process is continuously performed on a plurality of sheet groups, while a previous sheet group is being subjected to the staple process in the staple processing device 52, the retreating drum 63 winds the first sheet of a next sheet group around the surface of the retreating drum 63 to be waiting. By the operation of the retreating drum 63, it is not necessary to temporarily stop the carry-in of sheets from the body 1 while the staple process is being performed, resulting in the improvement of productivity.

Figure 2:
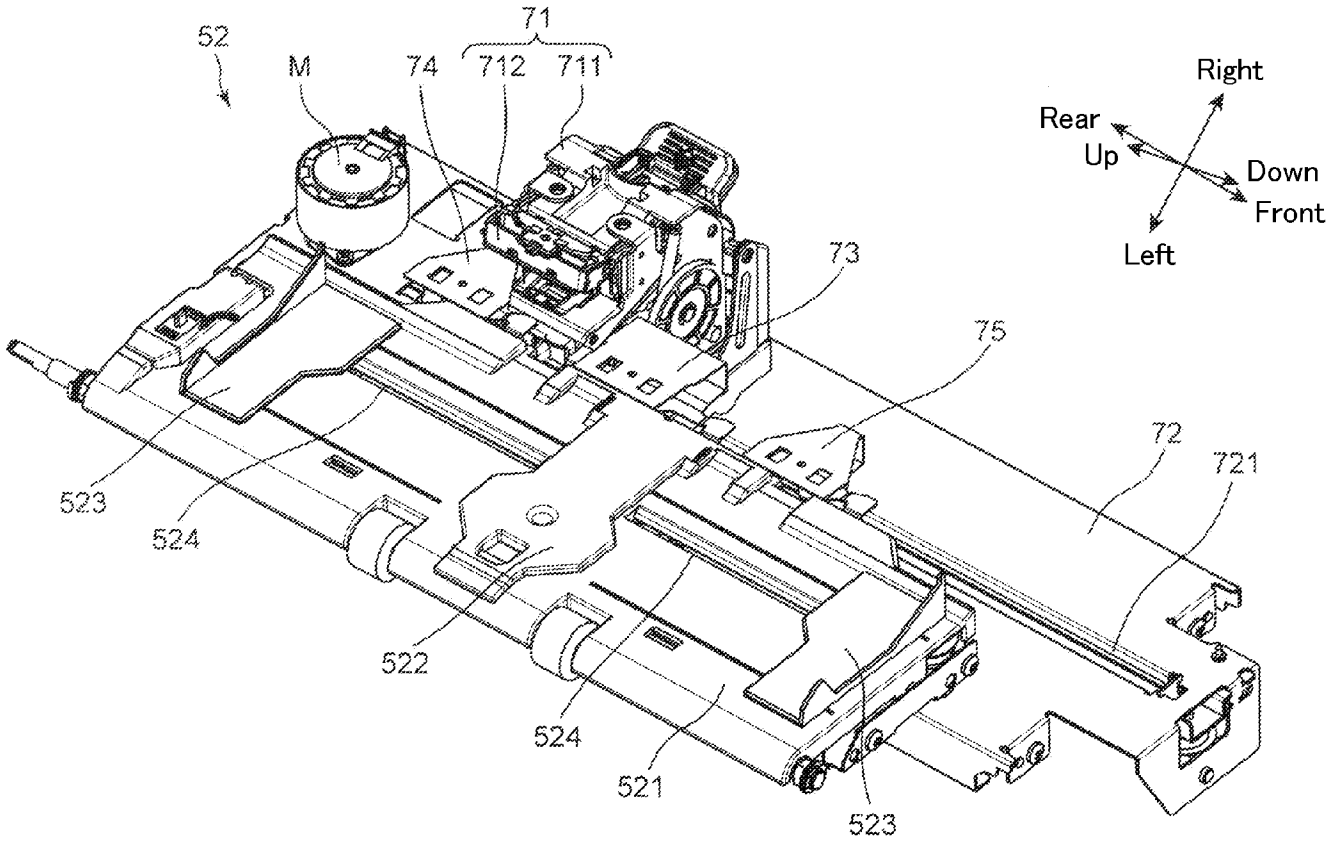
FIG. 2 is a perspective view of a tray unit and a staple unit of a post-processing device according to an embodiment.
Figure 3A:
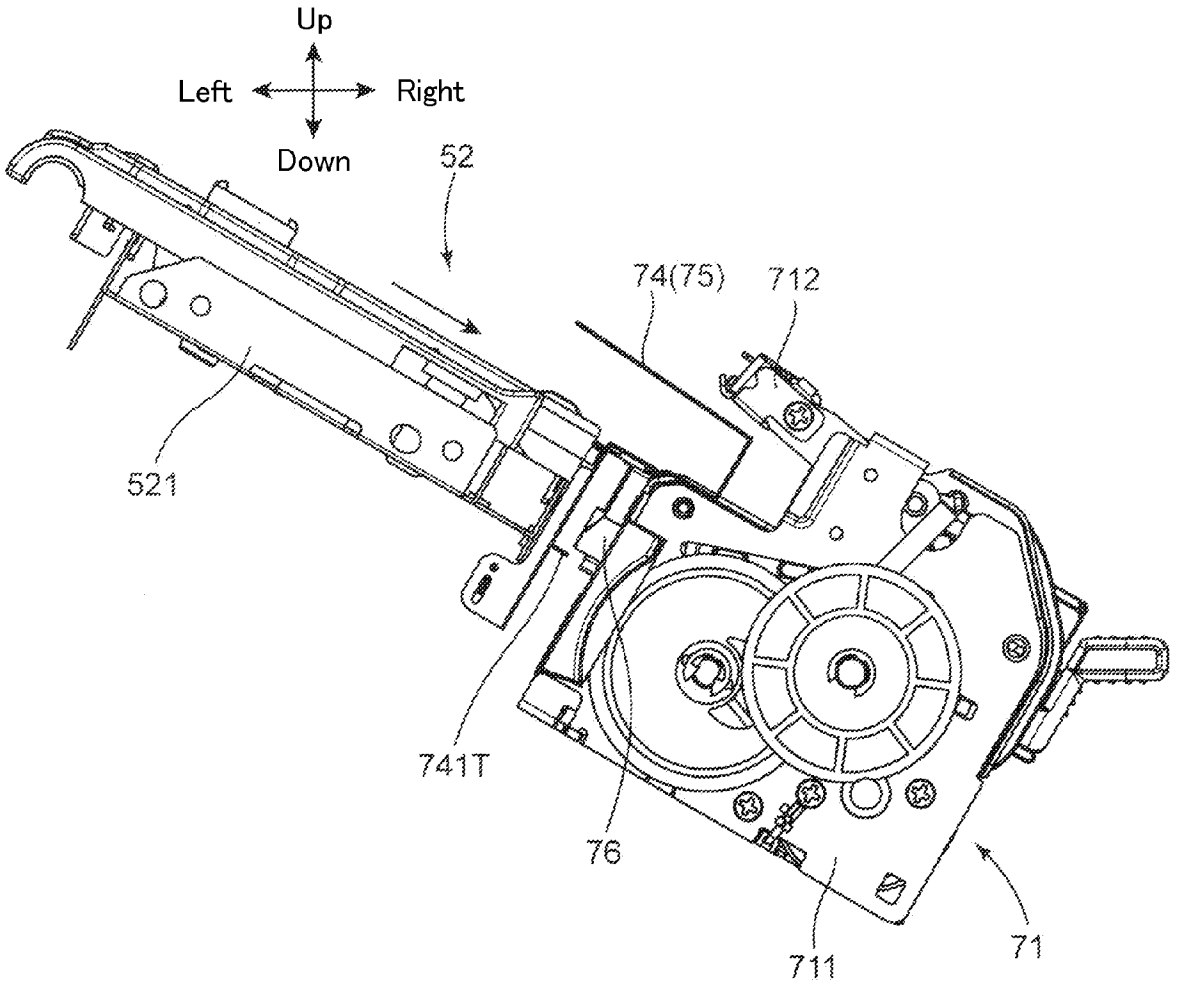
FIG. 3A is a side view of a tray unit and a staple unit of a post-processing device according to an embodiment.
Figure 3B:
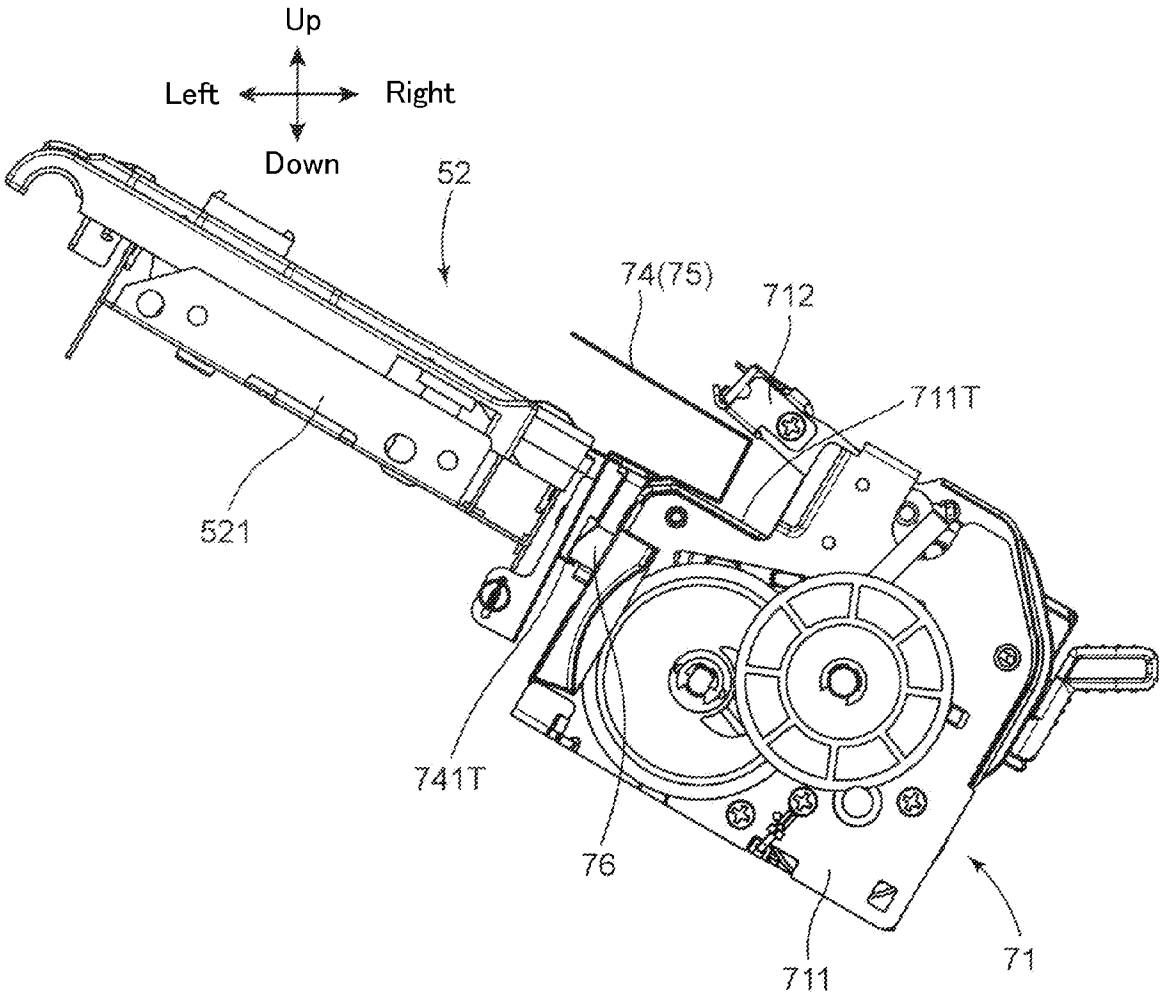
FIG. 3B is a side view of a tray unit and a staple unit of a post-processing device according to an embodiment.
Figure 4:
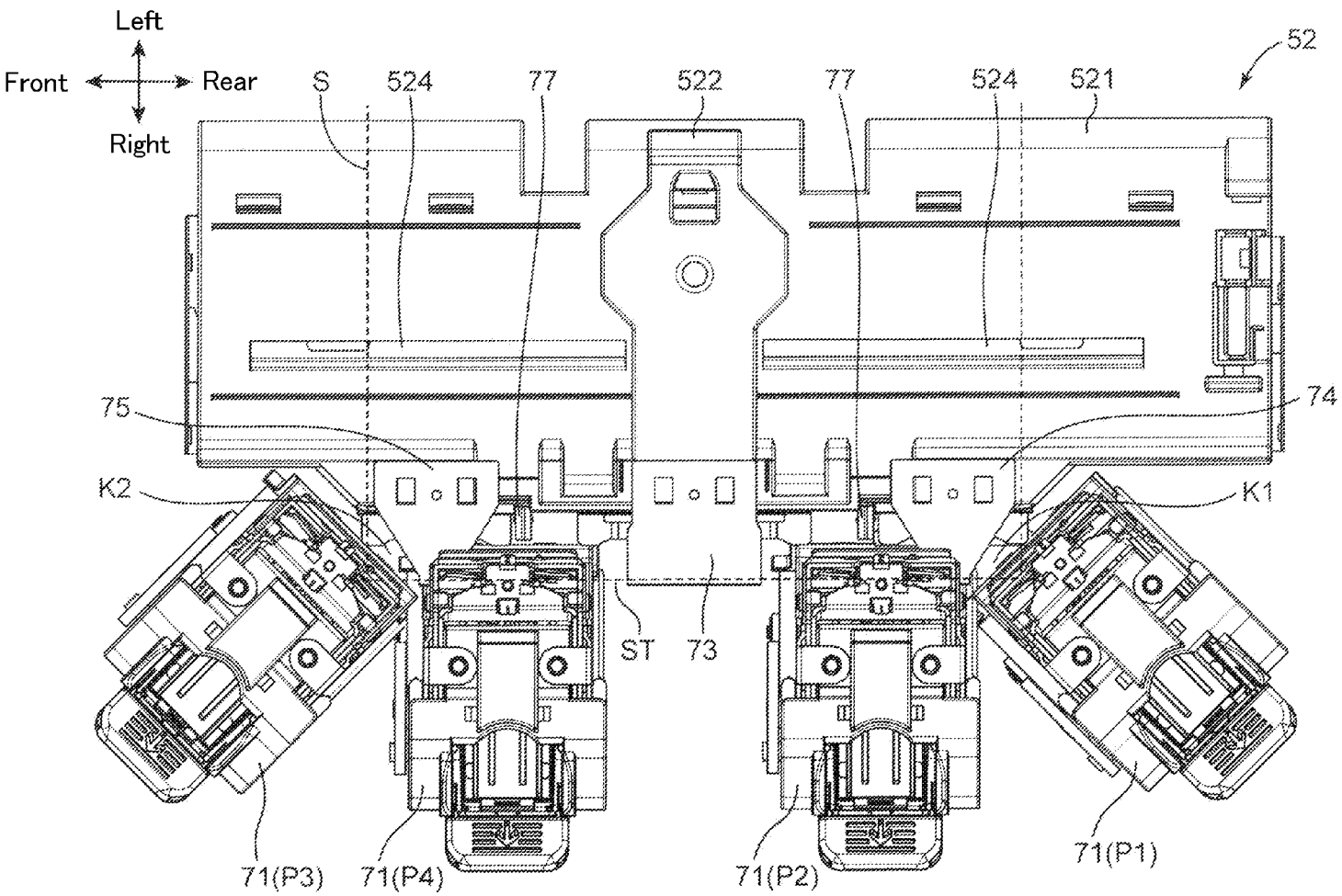
FIG. 4 is a plan view illustrating the arrangement of a staple unit of a post-processing device according to an embodiment.
Figure 5A:
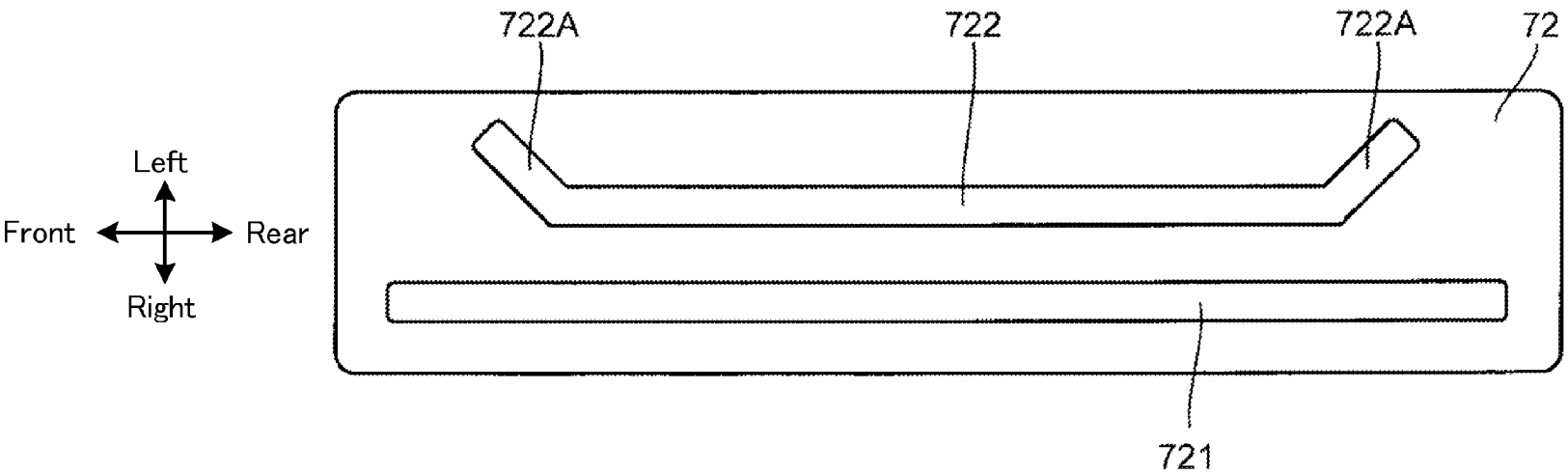
FIG. 5A is a schematic plan view of a movement section of a staple unit of a post-processing device according to an embodiment.
Figure 5B:
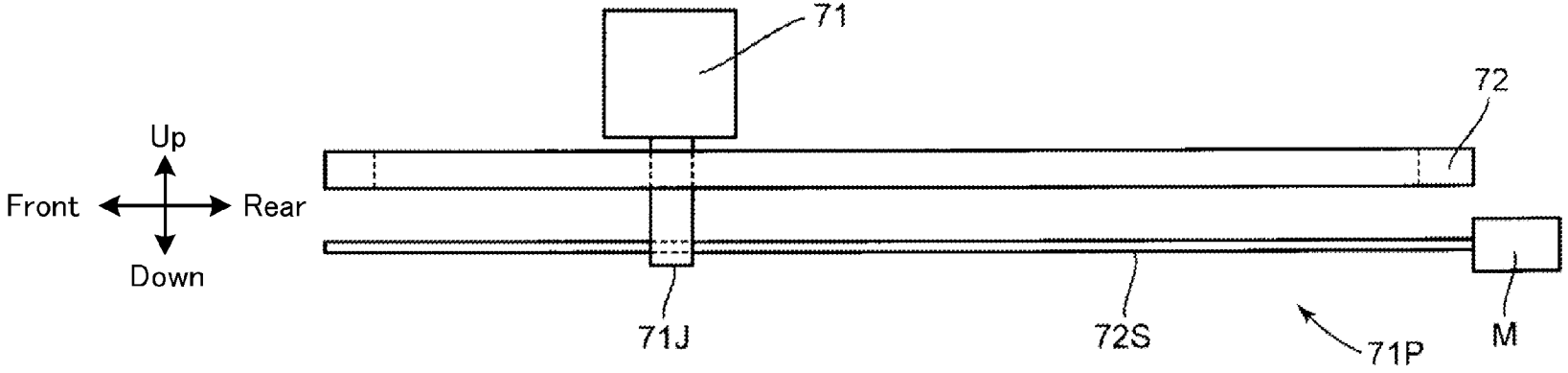
FIG. 5B is a schematic side view of a movement section of a staple unit of a post-processing device according to an embodiment.

Next, with reference to FIG. 2 to FIG. 5, the staple processing device 52 according to the present embodiment will be described in detail. FIG. 2 is a perspective view of the staple tray 521 and the staple unit 71 of the staple processing device 52 according to the present embodiment. FIG. 3A and FIG. 3B are side views of the staple tray 521 and the staple unit 71. FIG. 4 is a plan view illustrating the arrangement of the staple unit 71. FIG. 5A and FIG. 5B are schematic plan view and side view of a movement section 71P of the staple unit 71 of the staple processing device 52.

Referring to FIG. 2, the staple processing device 52 includes the staple tray 521 (a tray unit), the staple unit 71, the movement section 71P (FIG. 5B), a center reference plate 73, a rear reference plate 74 (a reference plate), and a front reference plate 75 (a reference plate).

The staple tray 521 is a rectangular tray extending in front/rear and right/left directions. On the staple tray 521, a plurality of sheets to be subjected to the staple process are loaded. At this time, the plurality of sheets are carried in the staple tray 521 along a conveyance direction directed to the right and downward direction. In addition, as described above, a sheet bundle subjected to the staple process is finally discharged to the main discharge tray 54 toward the left and upward direction opposite to the aforementioned conveyance direction (FIG. 1). The staple tray 521 includes a tray center part 522, a pair of width restraint members 523, and a pair of slide grooves 524. The tray center part 522 is disposed at the center of an upper surface portion of the staple tray 521 in the front and rear direction (the sheet width direction). The tray center part 522 is a thin plate-like member, which is fixed on the staple tray 521 with a slight height. The pair of width restraint members 523 are disposed so as to interpose the tray center part 522 therebetween in the front and rear direction. The width restraint members 523 restrain the positions in the sheet width direction of a plurality of sheets carried in the staple tray 521. The width restraint member 523 is a thin plate-like member similarly to the tray center part 522, and is provided at an end portion thereof in the front and rear direction with a side wall vertically installed upward. The slide grooves 524 are groove portions formed so as to extend in the staple tray 521 in the front and rear direction. The width restraint members 523 are movable along the slide grooves 524 in the front and rear direction via a rack and a pinion gear (not illustrated). In the present embodiment, whenever sheets are carried in the staple tray 521, the width restraint members 523 are moved by a driving mechanism (not illustrated). As a consequence, a plurality of sheets loaded on the staple tray 521 are aligned in the sheet width direction.

Referring to FIG. 2 and FIG. 4, the staple unit 71 is disposed to face an end ST (FIG. 4) of a front end side (a right side) of a sheet in the conveyance direction. The staple unit 71 is movable along the end ST in the sheet width direction perpendicular to the conveyance direction, and performs the staple process on a plurality of sheets. The staple unit 71 includes a staple body part 711 and a staple movable part 712 (FIG. 2). The staple body part 711 is a body part of the staple unit 71 and accommodates a plurality of staple needles therein. The staple movable part 712 is movable up and down and drives the staple needles into a sheet. As illustrated in FIG. 3A, a concave portion for allowing the entrance of the end ST of the sheet is formed between the staple body part 711 and the staple movable part 712.

The movement section 71P (FIG. 5A and FIG. 5B) moves the staple unit 71 in the sheet width direction. The movement section 71P includes a stage 72, a support part 71J, a motor M, and a shaft part 72S. The stage 72 is a rectangular sheet metal member extending in the front/rear and right/left directions, and is disposed adjacent to the staple tray 521 in the post-processing device body 500 as illustrated in FIG. 2. The stage 72 includes a first guide groove 721 and a second guide groove 722. The first guide groove 721 is an elongated opening opened at a right side end portion of the stage 72 along the front and rear direction. The second guide groove 722 is an elongated opening opened at a left side end portion of the stage 72 along the front and rear direction. The second guide groove 722 extends in parallel to the first guide groove 721, but bending portions 722A bent toward the left direction are respectively formed at both end portions of the second guide groove 722.

The support part 71J supports the staple unit 71. The support part 71J includes a pair of shaft support portions (not illustrated). The pair of shaft support portions are respectively inserted into the first guide groove 721 and the second guide groove 722. As a consequence, the staple unit 71 and the support part 71J slidably move along the first guide groove 721 and the second guide groove 722 in the front and rear direction together with each other. The motor M generates driving force for moving the staple unit 71. The motor M generates rotary driving force of a forward and reverse direction. The shaft part 72S is connected to the motor M and is rotated by the driving force of the motor M. A male screw (not illustrated) is formed on the peripheral surface of the shaft part 72S. A shaft hole (not illustrated) is formed at a lower end portion of the support part 71J, and the shaft part 72S is inserted into the shaft hole. A female screw (not illustrated) is formed on an inner peripheral surface of the shaft hole of the support part 71J. As a consequence, when the shaft part 72S is rotated by the motor M, the staple unit 71 moves in the front and rear direction. When the staple unit 71 reaches both end portions of the stage 72, one of the pair of shaft support portions disposed at the support part 71J enters into the bending portions 722A. At this time, an interval between the pair of shaft support portions is expanded, so that the posture of the staple unit 71 is changed to be inclined with respect to the front and rear direction (the sheet width direction) (see positions P1 and P3 of FIG. 4).

The center reference plate 73 is fixed to the staple tray 521 so as to face the right side end portion of the tray center part 522. The center reference plate 73 has an approximately U shape with an opened left side when viewed in a sectional view perpendicular to the sheet width direction. The center reference plate 73 abuts the ends ST of a plurality of sheets and aligns the plurality of sheets in the conveyance direction.

The rear reference plate 74 and the front reference plate 75 are disposed on the staple tray 521 at an interval in the sheet width direction so as to interpose the center reference plate 73 therebetween in the sheet width direction. The rear reference plate 74 and the front reference plate 75 abut the ends ST of the plurality of sheets together with the center reference plate 73 and align the plurality of sheets. The rear reference plate 74 and the front reference plate 75 are supported to slidably move in the front and rear direction by a guide mechanism (not illustrated). The rear reference plate 74 and the front reference plate 75 also have an approximately U shape similarly to the center reference plate 73 as will be described later. By the rear reference plate 74 and the front reference plate 75, it is possible to stably align both end sides of the sheets at different positions in the sheet width direction.

Referring to FIG. 4, in the present embodiment, the staple unit 71 can be disposed at a plurality of (four) staple positions P1 to P4 by the movement section 71P (FIG. 5B), and performs the staple process on a sheet S. The sheet S illustrated in FIG. 4 is a sheet of A4 size as an example. In this case, the end ST of the sheet S corresponds to a short side (a length of 210 mm) of the A4 size. In the sheet width direction, a plurality of sheets S are loaded on the staple tray 521 about the center reference plate 73. A rear corner part of the sheet S formed by the end ST of the sheet S is defined as a first corner part K1, and a front corner part of the sheet S formed by the end ST at an opposite side of the first corner part K1 is defined as a second corner part K2.

In FIG. 4, when the staple unit 71 is disposed at the first staple position P1, the staple unit 71 is inclined by a predetermined angle with respect to the sheet width direction (the front and rear direction) and is disposed to face the first corner part K1 of the sheet S. When the staple process of the staple unit 71 is performed at the first staple position P1, the staple needle is driven into the first corner part K1 of the sheet S. On the other hand, at the second staple position P2 of the staple unit 71, the staple unit 71 is disposed along the end ST at an inner side in the sheet width direction from the first staple position P1. When the staple process of the staple unit 71 is performed at the second staple position P2, the staple needle is driven into a rear side portion in the vicinity of the end ST of the sheet S.

Moreover, when the staple unit 71 is disposed at the third staple position P3, the staple unit 71 is inclined by a predetermined angle with respect to the sheet width direction and is disposed to face the second corner part K2 of the sheet S. When the staple process of the staple unit 71 is performed at the third staple position P3, the staple needle is driven into the second corner part K2 of the sheet S. At the fourth staple position P4 of the staple unit 71, the staple unit 71 is disposed along the end ST at an inner side in the sheet width direction from the third staple position P3. In other words, the staple unit 71 is disposed between the second staple position P2 and the third staple position P3. When the staple process of the staple unit 71 is performed at the fourth staple position P4, the staple needle is driven into a front side portion in the vicinity of the end ST of the sheet S. In addition, in the state in which the plurality of sheets S have been loaded on the staple tray 521, when the staple unit 71 sequentially performs the staple process at the second staple position P2 and the fourth staple position P4, the staple needle is driven at two places of the end ST of the sheet S, so that the plurality of sheets S are fixed at two points.

As described above, when the size of the sheet S carried in the staple tray 521 is A4 SEF (Short Edge Feed: the sheet S is conveyed such that one short side of the sheet S becomes a front end side in the conveyance direction (in a direction following the long side of the sheet S)), the arrangement of the rear reference plate 74 and the front reference plate 75 tends to be difficult. That is, in order for the staple unit 71 to perform the staple process on the first corner part K1, the first corner part K1 needs to be exposed as illustrated in FIG. 4. Therefore, the rear reference plate 74 should be disposed at a front side from the first corner part K1 at a predetermined interval as illustrated in FIG. 4. On the other hand, in the state in which the rear reference plate 74 has been disposed at the position illustrated in FIG. 4, when the staple unit 71 moves to the second staple position P2, it reaches a state in which the rear reference plate 74 has entered into the concave portion of the staple unit 71 (FIG. 3B), in other words, a state in which the staple movable part 712 of the staple unit 71 and the rear reference plate 74 interfere with each other. In this case, the staple process of the staple unit 71 is not normally performed at the second staple position P2. In addition, the arrangement of the front reference plate 75 when the staple unit 71 performs the staple process at the third staple position P3 and the fourth staple position P4 is also performed in a similar manner. As described above, when the staple position of the staple unit 71 is set in advance in correspondence to a sheet of A4 SEF size, interference between the rear reference plate 74 and the front reference plate 75 disposed at both end sides of the sheet S and the staple unit 71 tends to be a problem.

Figure 6A:
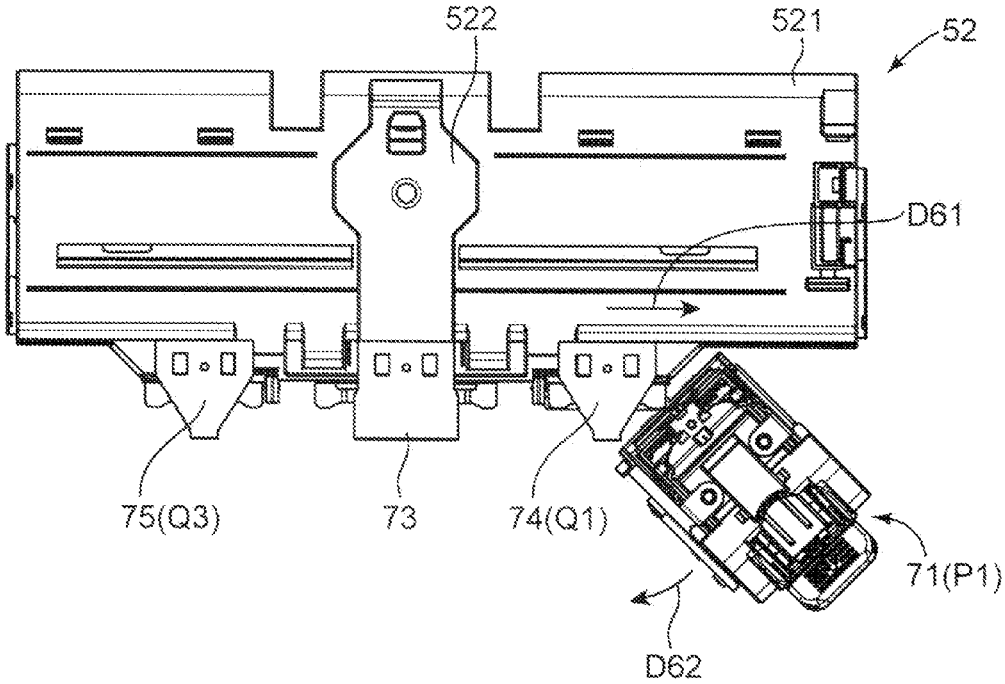
FIG. 6A is a plan view illustrating an aspect in which a staple unit of a post-processing device according to an embodiment moves.
Figure 11A:
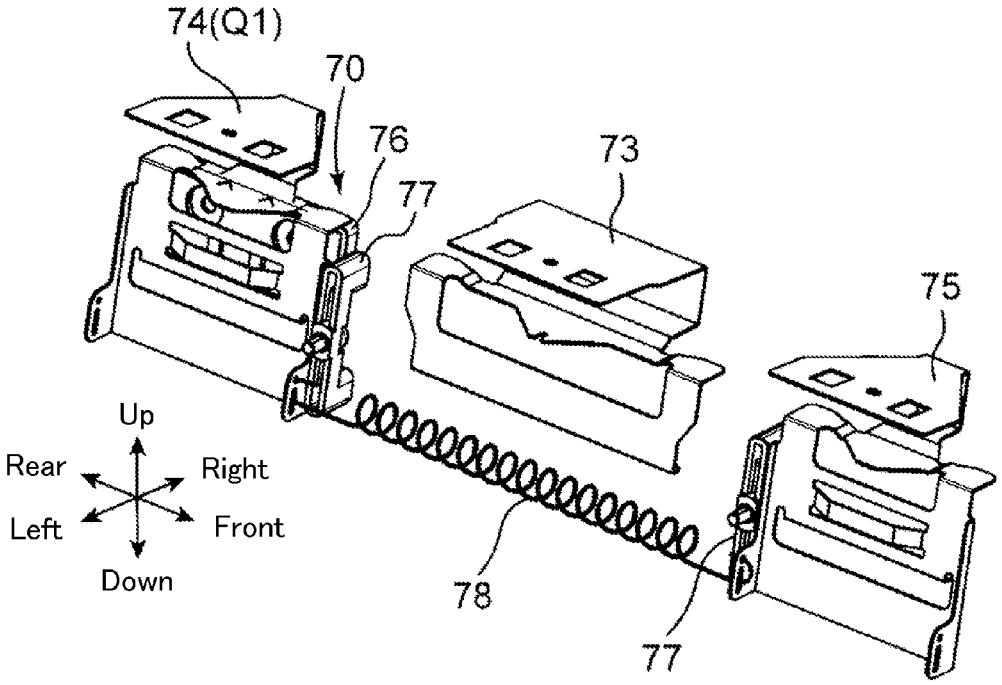
FIG. 11A is a perspective view illustrating an aspect in which a reference plate of a post-processing device according to an embodiment moves.

In order to solve such a problem, in the present embodiment, the staple processing device 52 includes an interlocking mechanism 70 (FIG. 11A). The interlocking mechanism 70 moves the rear reference plate 74 and the front reference plate 75 in the sheet width direction in interlock with the movement of the staple unit 71. Next, an aspect in which the rear reference plate 74 and the front reference plate 75 are moved will be described. FIG. 6A thorough FIG. 7B are plan views illustrating an aspect in which the staple unit of the post-processing device 5 according to the present embodiment moves. As described above, the staple unit 71 slidingly moves in the sheet width direction so as to be disposed at the first staple position P1, the second staple position P2, the fourth staple position P4, and the third staple position P3.

Figure 6B:
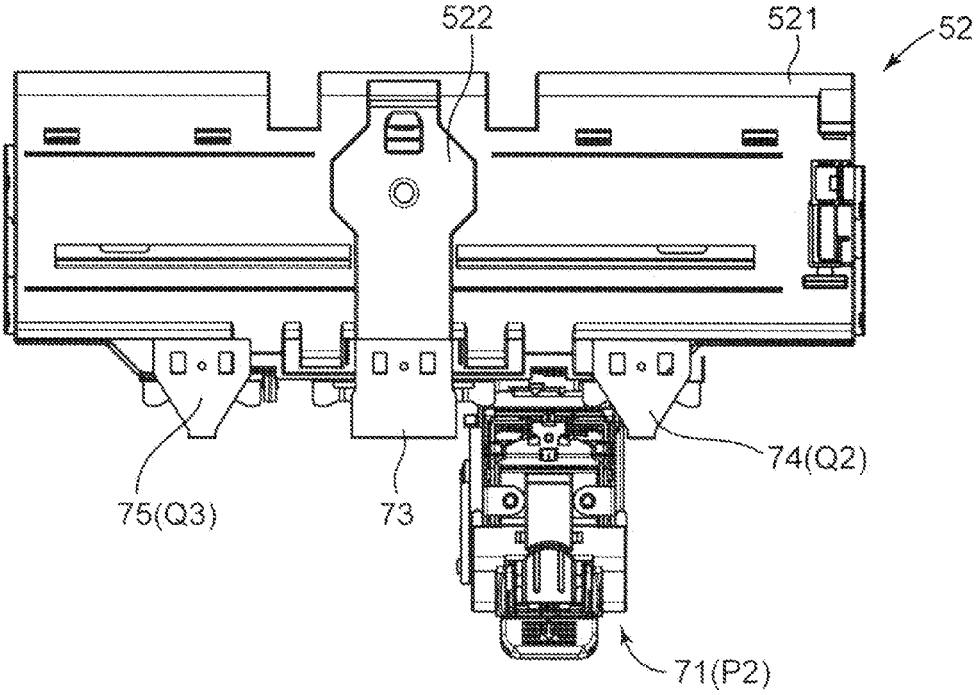
FIG. 6B is a plan view illustrating an aspect in which a staple unit of a post-processing device according to an embodiment moves.

In the present embodiment, the rear reference plate 74 for aligning the end ST (FIG. 4) of the sheet S slidably moves in the sheet width direction so as to be disposed at a first reference position Q1 (FIG. 6A) and a second reference position Q2 (FIG. 6B). The first reference position Q1 of the rear reference plate 74 is set to an inner side in the sheet width direction from the first staple position P1 of the staple unit 71, so as to overlap the second staple position P2 (FIG. 6B). On the other hand, the second reference position Q2 of the rear reference plate 74 is set to an outer side in the sheet width direction from the first reference position Q1 of the rear reference plate 74 and the second staple position P2 of the staple unit 71. Furthermore, the second reference position Q2 of the rear reference plate 74 is arranged to overlap the first staple position P1 of the staple unit 71. Therefore, the staple processing device 52 of the post-processing device 5 is compactly set in the sheet width direction.

Figure 7A:
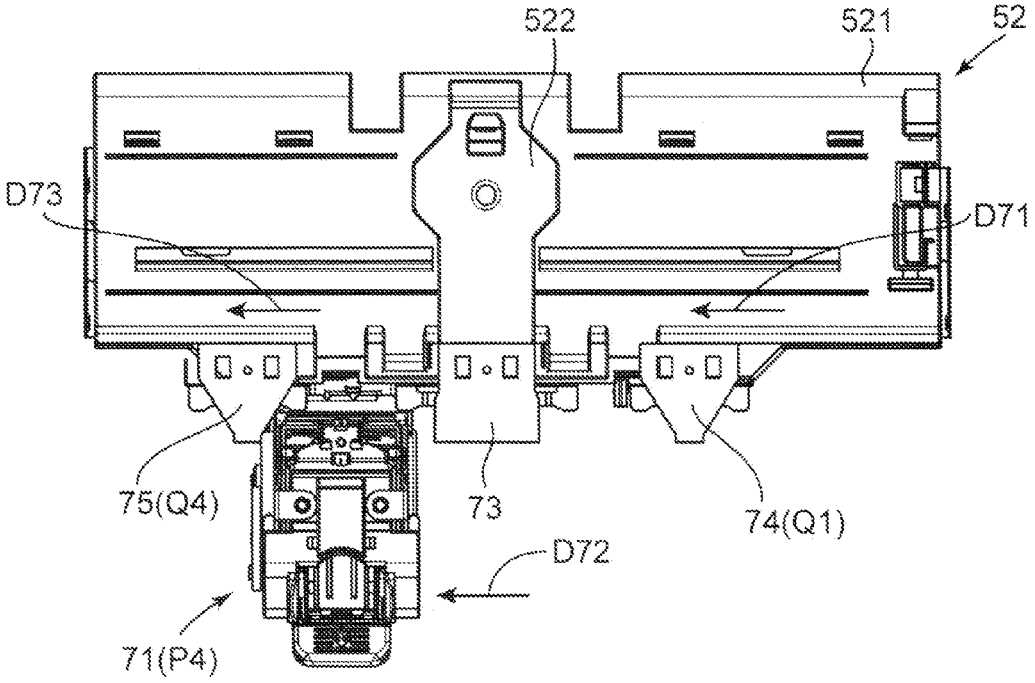
FIG. 7A is a plan view illustrating an aspect in which a staple unit of a post-processing device according to an embodiment moves.
Figure 7B:
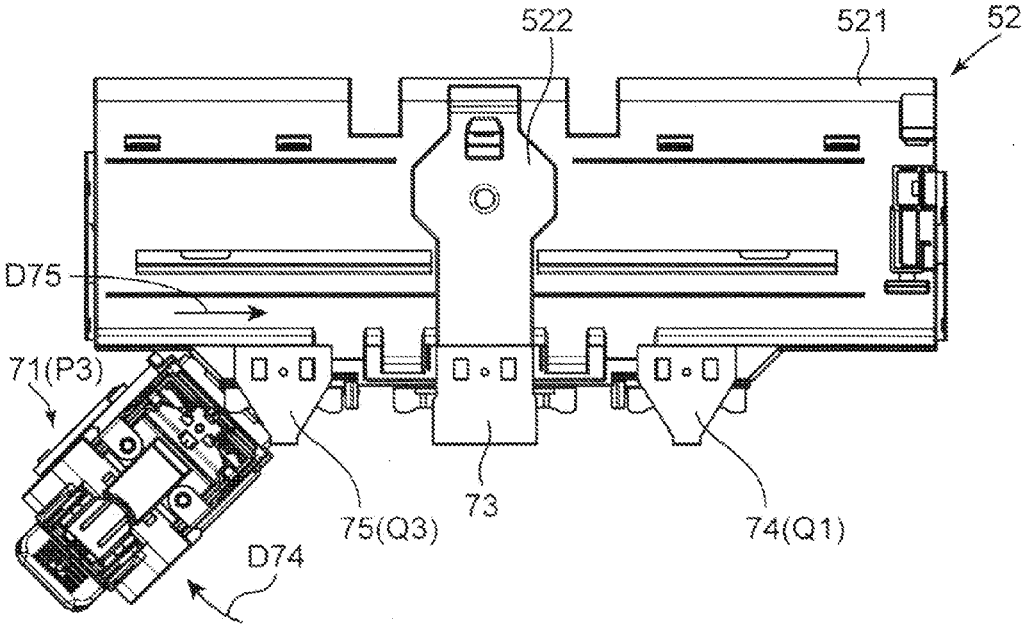
FIG. 7B is a plan view illustrating an aspect in which a staple unit of a post-processing device according to an embodiment moves.

Similarly, the front reference plate 75 for aligning the end ST (FIG. 4) of the sheet S slidably moves in the sheet width direction so as to be disposed at a third reference position Q3 (FIG. 7B) and a fourth reference position Q4 (FIG. 7A). The third reference position Q3 (FIG. 7B) of the front reference plate 75 is set to an inner side in the sheet width direction from the third staple position P3 (FIG. 7B) of the staple unit 71 so as to overlap the fourth staple position P4 (FIG. 7A). On the other hand, the fourth reference position Q4 (FIG. 7A) of the front reference plate 75 is set to an outer side in the sheet width direction from the third reference position Q3 of the front reference plate 75 and the fourth staple position P4 of the staple unit 71. Furthermore, the fourth reference position Q4 of the front reference plate 75 is arranged to overlap the third staple position P3 of the staple unit 71.

When the staple unit 71 is disposed at the first staple position P1, the interlocking mechanism 70 disposes the rear reference plate 74 at the first reference position Q1 (FIG. 6A). Therefore, at the first staple position P1 illustrated in FIG. 6A, the staple unit 71 does not interfere with the rear reference plate 74, so that the staple process of the staple unit 71 is stably performed. Furthermore, the interlocking mechanism 70 moves (an arrow D61 of FIG. 6A) the rear reference plate 74 from the first reference position Q1 to the second reference position Q2 in interlock with the movement (an arrow D62 of FIG. 6A) of the staple unit 71 from the first staple position P1 to the second staple position P2. At this time, the staple unit 71 and the rear reference plate 74 move in opposite directions while passing each other such that the rear reference plate 74 passes through the concave portion between the staple body part 711 and the staple movable part 712 of the staple unit 71 (FIG. 3A and FIG. 3B). As a consequence, at the second staple position P2 illustrated in FIG. 6B, the staple unit 71 does not interfere with the rear reference plate 74, so that the staple process of the staple unit 71 is stably performed. In addition, in contrary to the above, when the staple unit 71 is moved from the second staple position P2 (FIG. 6B) to the first staple position P1 (FIG. 6A), the interlocking mechanism 70 moves the rear reference plate 74 from the second reference position Q2 to the first reference position Q1. Therefore, interference between the staple unit 71 returned to the first staple position P1 and the rear reference plate 74 is prevented, so that the staple process is stably performed on the sheet S. As described above, the rear reference plate 74 can align the sheet S at the first and second reference positions Q1 and Q2 set along the end ST of the sheet S (FIG. 4).

Moreover, when the staple unit 71 moves from the second staple position P2 illustrated in FIG. 6B to the fourth staple position P4 (an arrow D72 of FIG. 7A), the interlocking mechanism 70 moves the rear reference plate 74 from the second reference position Q2 to the first reference position Q1 (an arrow D71 of FIG. 7A) in interlock with the movement of the staple unit 71. Furthermore, in interlock with the movement of the staple unit 71 from the second staple position P2 illustrated in FIG. 6B to the fourth staple position P4, the interlocking mechanism 70 moves the front reference plate 75 from the third reference position Q3 illustrated in FIG. 6B to the fourth reference position Q4 of FIG. 7A (an arrow D73 of FIG. 7A). Consequently, at the fourth staple position P4 illustrated in FIG. 7A, the staple unit 71 does not interfere with the front reference plate 75, so that the staple process of the staple unit 71 is stably performed. At this time, since the rear reference plate 74 returns to the first reference position Q1, the rear reference plate 74 can stably align the end ST of the sheet S at the first reference position Q1.

Moreover, when the staple unit 71 moves from the fourth staple position P4 illustrated in FIG. 7A to the third staple position P3 (an arrow D74 of FIG. 7B), the interlocking mechanism 70 moves the front reference plate 75 from the fourth reference position Q4 to the third reference position Q3 (an arrow D75 of FIG. 7B) in interlock with the movement of the staple unit 71. Consequently, at the third staple position P3 illustrated in FIG. 7B, the staple unit 71 does not interfere with the front reference plate 75, so that the staple process of the staple unit 71 is stably performed.

In addition, when the staple unit 71 returns again to the second staple position P2 from the third staple position P3 or the fourth staple position P4 (FIG. 6B), the interlocking mechanism 70 moves the rear reference plate 74 that has been returned to the first reference position Q1 to the second reference position Q2 again in interlock with the movement of the staple unit 71. As described above, in any one of the case in which the staple unit 71 moves from the first staple position P1 to the second staple position P2 and the case in which the staple unit 71 moves from the fourth staple position P4 to the second staple position P2, the interlocking mechanism 70 moves the rear reference plate 74 from the first reference position Q1 to the second reference position Q2 at an outer side in the sheet width direction. As a consequence, interference between the staple unit 71 and the rear reference plate 74 at the time of the staple process is reliably prevented.

Figure 8:
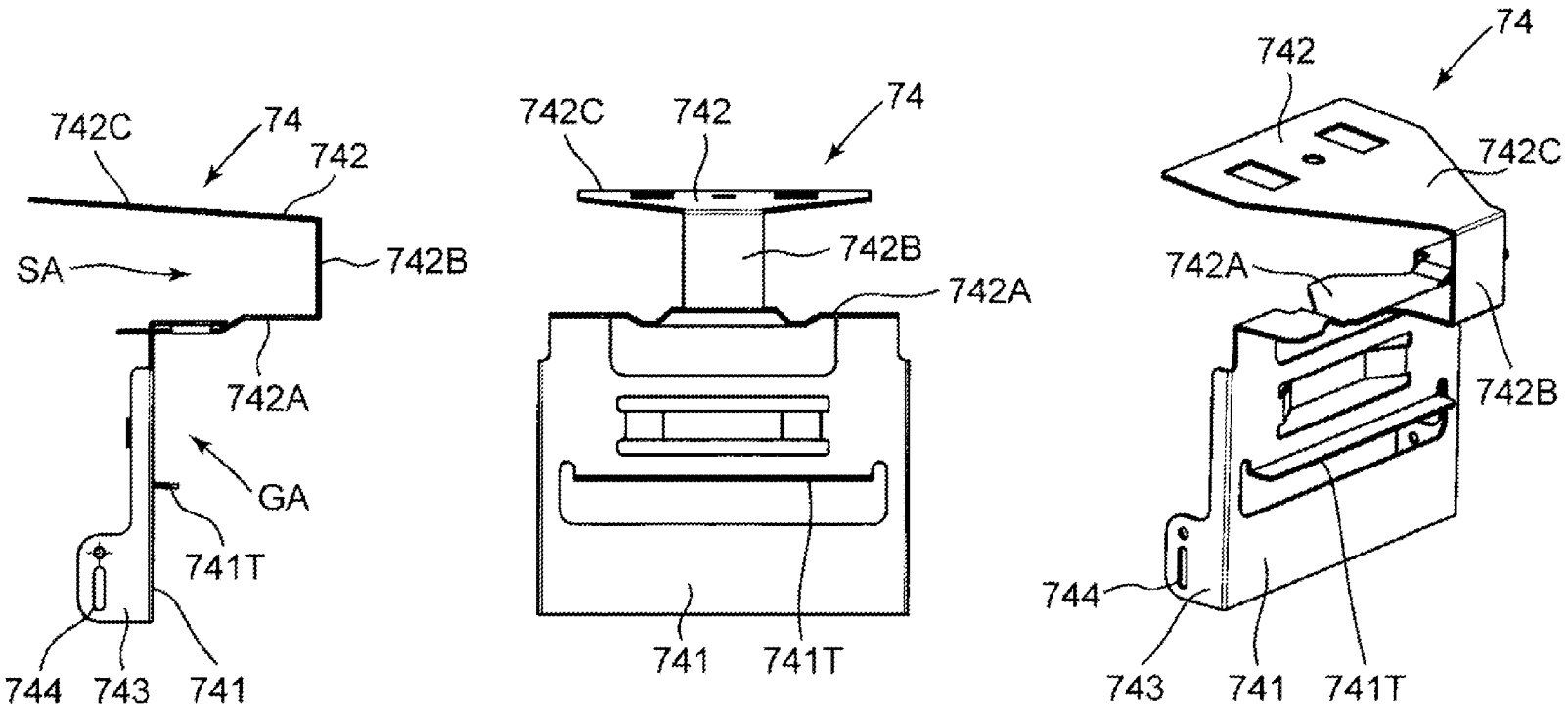
FIG. 8 is a front view, a side view, and a perspective view of a reference plate of a post-processing device according to an embodiment.
Figure 9:
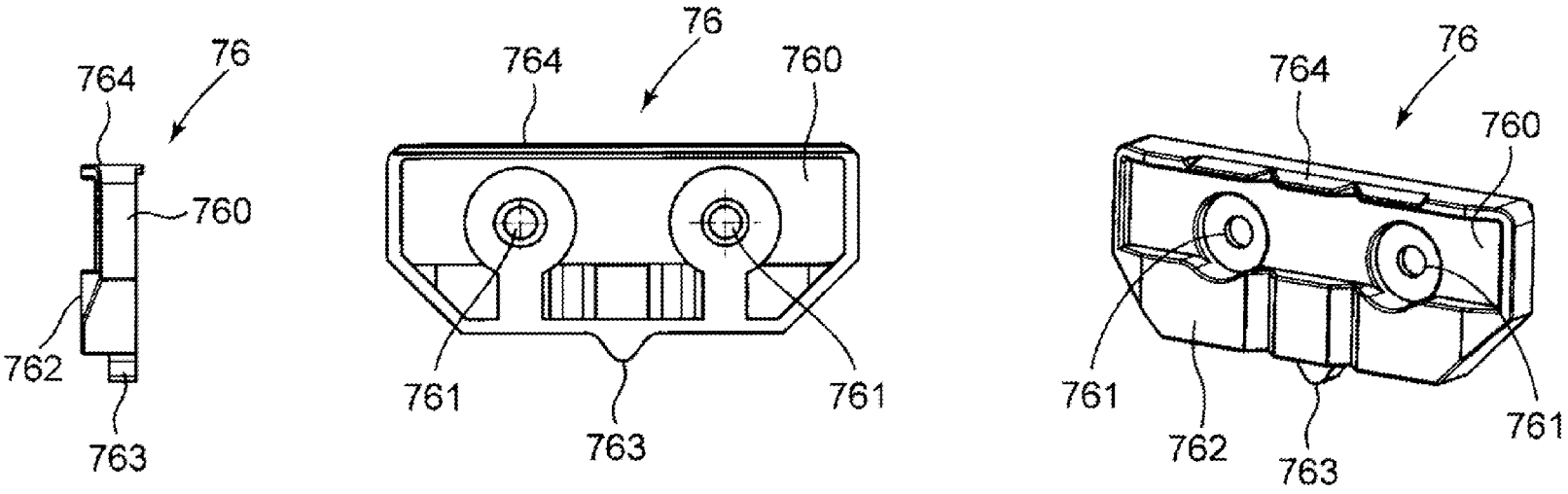
FIG. 9 is a front view, a side view, and a perspective view of a pressing member of an interlocking mechanism of a post-processing device according to an embodiment.
Figure 10:
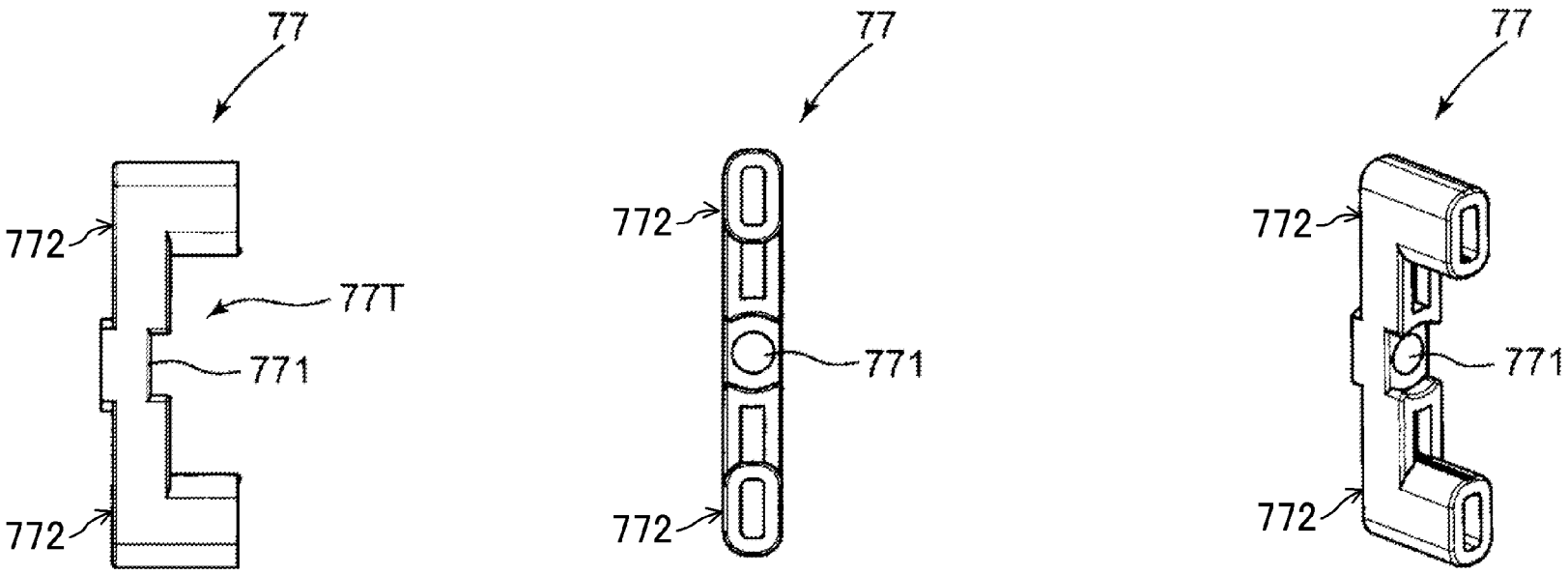
FIG. 10 is a front view, a side view, and a perspective view of a rotating member of an interlocking mechanism of a post-processing device according to an embodiment.

Next, the movement of the rear reference plate 74 by the interlocking mechanism 70 will be described in more detail. FIG. 8 is a front view, a side view, and a perspective view of the rear reference plate 74 of the staple processing device 52 according to the present embodiment. In addition, the front reference plate 75 also has a shape similar to that of the rear reference plate 74. FIG. 9 is a front view, a side view, and a perspective view of an engagement guide 76 of the interlocking mechanism 70 of the staple processing device 52. FIG. 10 is a front view, a side view, and a perspective view of a link member 77 of the interlocking mechanism 70 of the staple processing device 52. Furthermore, FIGS. 11A, 12A, 13A, 14A, 15A, and 16A are perspective views illustrating aspects in which the rear reference plate 74 moves in the sheet width direction, and FIGS. 11B, 12B, 13B, 14B, 15B, and 16B are side views illustrating aspects in which the rear reference plate 74 moves in a similar manner.

Referring to FIG. 8, the rear reference plate 74 includes a reference plate body 741 and a sheet restraint part 742. The reference plate body 741 corresponds to a lower portion of the rear reference plate 74 and is a rectangular sheet metal part extending in the up/down and right/left directions. The reference plate body 741 includes a protruding piece 741T and a pair of side portions 743. The protruding piece 741T is a protruding piece that protrudes from the reference plate body 741. The protruding piece 741T protrudes in an approximately horizontal direction and extends in the front and rear direction. Furthermore, the protruding piece 741T protrudes toward an opposite side of the staple tray 521, that is, the side of the staple unit 71 (see FIG. 3A). The side portions 743 protrude from both end portions of the reference plate body 741 in the front and rear direction toward an opposite side of the protruding piece 741T, that is, the side of the staple tray 521. The side portion 743 is formed with a spring engaging hole 744. The spring engaging hole 744 is an opening having a long hole shape, which is opened in each of the pair of side portions 743.

The sheet restraint part 742 is connected to an upper end portion of the reference plate body 741. The sheet restraint part 742 has an approximately U shape when viewed in a sectional view (see the left front view of FIG. 8) crossing the sheet width direction. The sheet restraint part 742 includes a sheet loading portion 742A on which the front end of the sheet S is loaded, a restraint portion 742B abutted by the front end of the sheet S, and a pressing portion 742C facing an upper surface portion of the loaded sheet S. The front end portions of the plurality of sheets S are disposed in a sheet accommodating space SA surrounded by the sheet loading portion 742A, the restraint portion 742B, and the pressing portion 742C.

Referring to FIG. 11A, the interlocking mechanism 70 includes an engagement guide 76 (a pressing member), a link member 77 (a rotating member), and a spring member 78 (an urging member).

The engagement guide 76 is fixed to the left side surface of the staple body part 711 of the staple unit 71 (FIG. 3A and FIG. 3B). The engagement guide 76 slidingly moves in the front and rear direction (the sheet width direction) together with the staple unit 71. The engagement guide 76 brings into contact with the link member 77 with the movement of the staple unit 71. Referring to FIG. 9, the engagement guide 76 includes a guide body 760, screw holes 761, an abutting portion 762, a protruding portion 763, and an upper end portion 764.

The guide body 760 is an elongated plate-like member. The screw holes 761 are a pair of hole portions opened at the guide body 760 at an interval in the sheet width direction. Screws (not illustrated) are inserted into the screw holes 761, so that the engagement guide 76 is fixed to the staple body part 711 by the screws. The abutting portion 762 is a protruding portion that protrudes from the guide body 760. The abutting portion 762 protrudes from the guide body 760 toward the staple tray 521 in FIG. 3A. The protruding portion 763 is a protrusion that protrudes downward from the center portion of the lower end portion of the guide body 760 in the sheet width direction. The upper end portion 764 corresponds to the upper end surface of the guide body 760.

Referring to FIG. 11A, the link member 77 is disposed as a pair adjacently to the inner sides of the rear reference plate 74 and the front reference plate 75 in the sheet width direction. The link member 77 includes a link support point part 771 (a support point part) and a pair of link pressing parts 772 (extending parts). The link support point part 771 is a support point extending along the conveyance direction of the sheet S. The link support point part 771 is a hole part opened at the center part of the link member 77, and a shaft (not illustrated) provided in the post-processing device body 500 is inserted into the link support point part 771. The link pressing parts 772 are a pair of protruding pieces each extending in the opposite direction from the link support point part 771 in a direction crossing the sheet width direction. As illustrated in FIG. 10, the front end portions of the pair of link pressing parts 772 are bent, so that the link member 77 has an approximately U shape. The link member is supported to the post-processing device body 500 (the staple tray 521) so as to be rotatable around the link support point part 771. That is, the link member 77 only rotates and does not slidingly move in the sheet width direction.

Referring to FIG. 11A, the spring member 78 is an extendable coil spring. A rear end portion of the spring member 78 is engaged with the spring engaging hole 744 (FIG. 8) of the front side of the rear reference plate 74, and a front end portion of the spring member 78 is engaged with the spring engaging hole 744 of the rear side of the front reference plate 75. As a consequence, the spring member 78 urges the rear reference plate 74 and the front reference plate 75 toward a direction in which the rear reference plate 74 and the front reference plate 75 approach each other. In other words, as illustrated in FIG. 6A and FIG. 7B, the spring member 78 urges the rear reference plate 74 from the second reference position Q2 to the first reference position Q1. Furthermore, the spring member 78 urges the front reference plate 75 from the fourth reference position Q4 to the third reference position Q3.

Figure 11B:
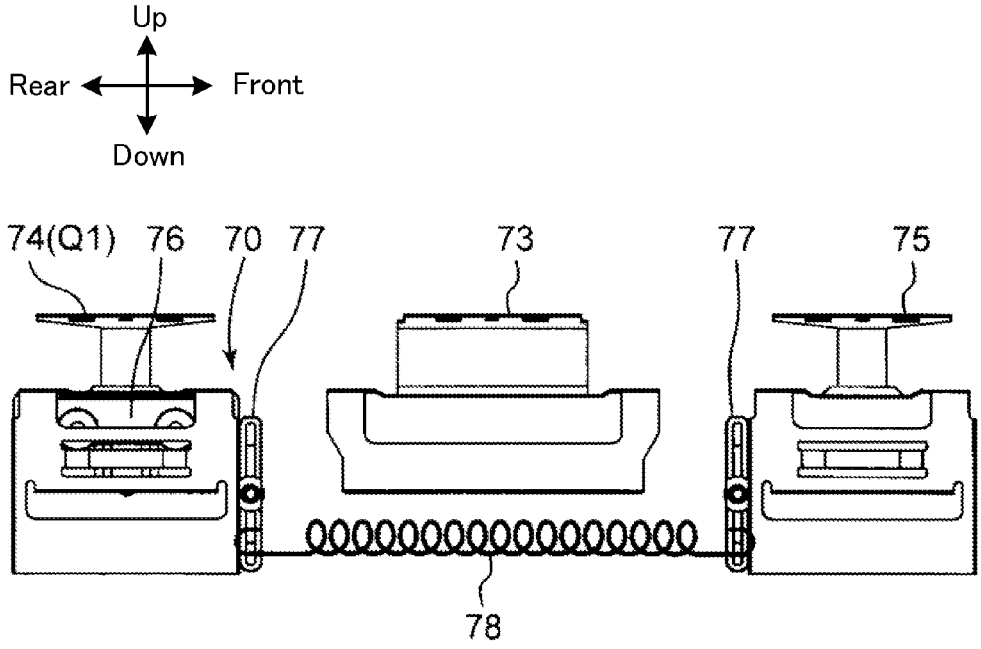
FIG. 11B is a side view illustrating an aspect in which a reference plate of a post-processing device according to an embodiment moves.

FIG. 11A, FIG. 11B, FIG. 12A, FIG. 12B, FIG. 13A, FIG. 13B, FIG. 14A, FIG. 14B, FIG. 15A, FIG. 15B, FIG. 16A, and FIG. 16B illustrate only the engagement guide 76 fixed to the staple unit 71 and does not illustrate the staple unit 71 for the purpose of description. FIG. 11A and FIG. 11B illustrate the state in which the staple unit 71 is moving from the first staple position P1 (FIG. 6A) to the second staple position P2 (FIG. 6B). When only urging force is applied to the rear reference plate 74 and the front reference plate 75 by the spring member 78, forces vertically act on the upper part and lower part of the link member 77 in a opposite direction mutually in the front and rear direction about the link support point part 771. Therefore, as illustrated in FIG. 11B, the pair of link members 77 stops at the positions in which they have been disposed so as to extend in the up and down direction. Furthermore, the side portions 743 (FIG. 8) of the rear reference plate 74 and the front reference plate 75 abut the link members 77.

Referring to FIG. 5A, when the support part 71J of the staple unit 71 is detached frontward from the rear bending portion 722A, the engagement guide 76 is positioned at the right side (the back side) of the rear reference plate 74 as illustrated in FIG. 11A. At this time, the engagement guide 76 is disposed at a guide passing portion GA of FIG. 8. Furthermore, the upper end portion 764 of the engagement guide 76 is disposed directly under the sheet loading portion 742A of the rear reference plate 74.

Figure 12A:
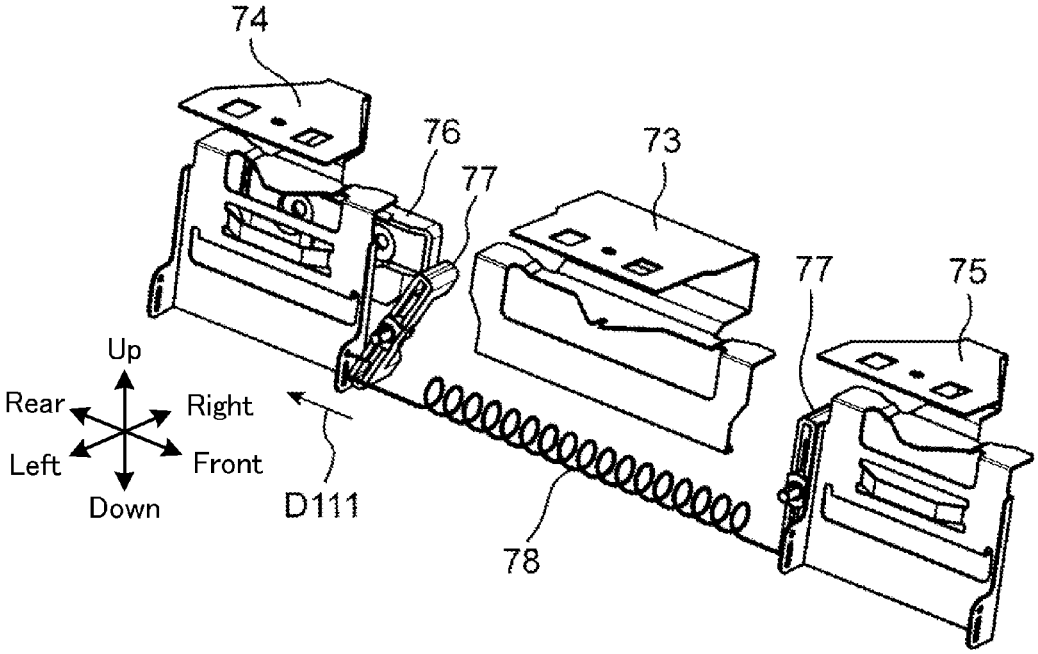
FIG. 12A is a perspective view illustrating an aspect in which a reference plate of a post-processing device according to an embodiment moves.
Figure 12B:
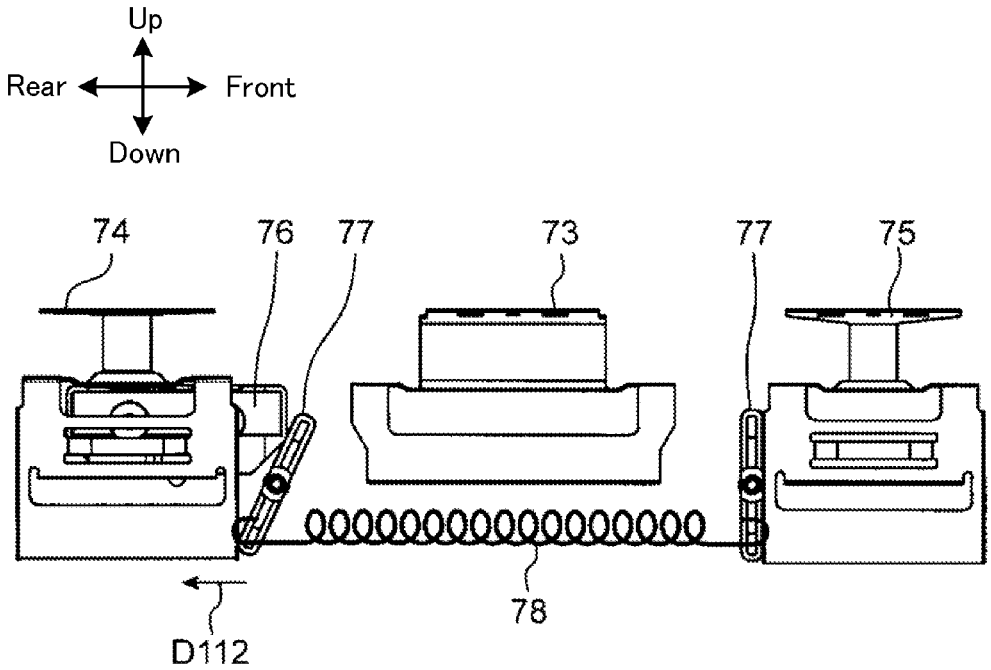
FIG. 12B is a side view illustrating an aspect in which a reference plate of a post-processing device according to an embodiment moves.
Figure 13A:
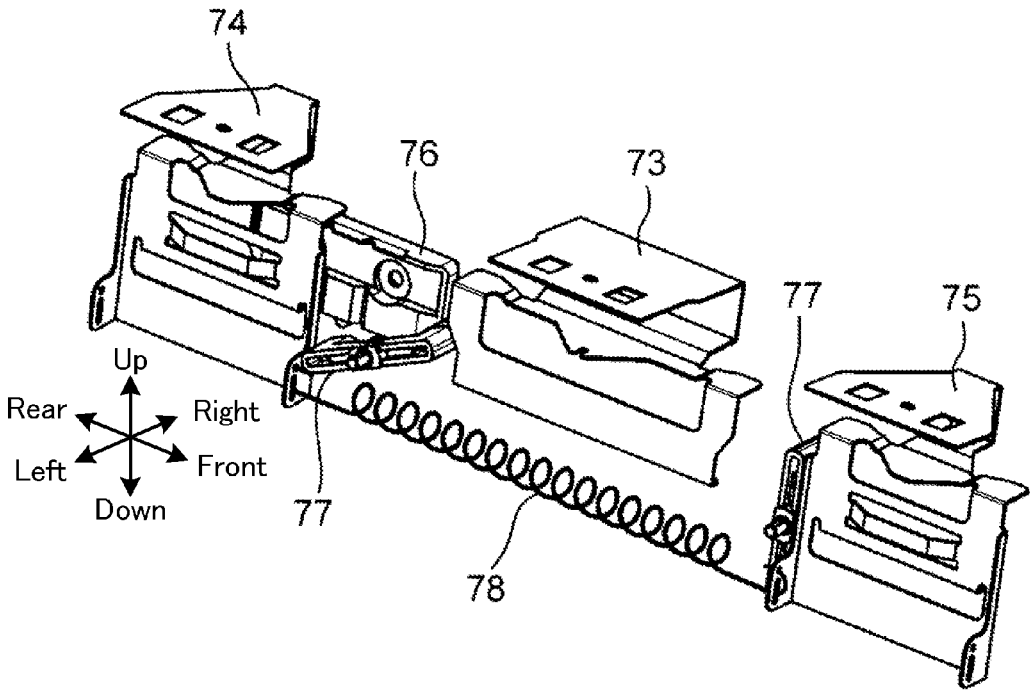
FIG. 13A is a perspective view illustrating an aspect in which a reference plate of a post-processing device according to an embodiment moves.
Figure 13B:
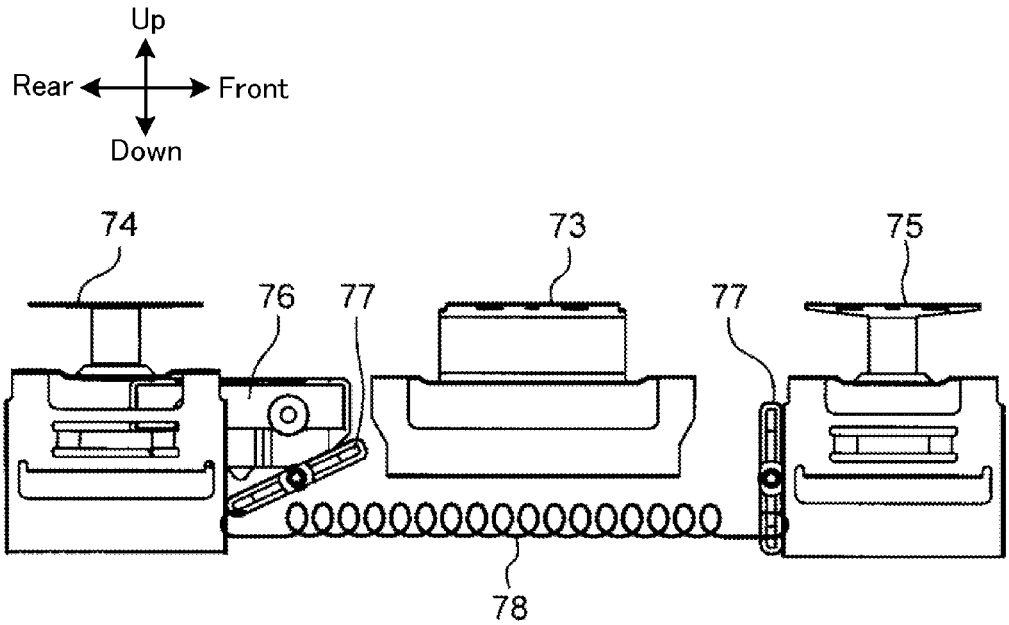
FIG. 13B is a side view illustrating an aspect in which a reference plate of a post-processing device according to an embodiment moves.
Figure 14A:
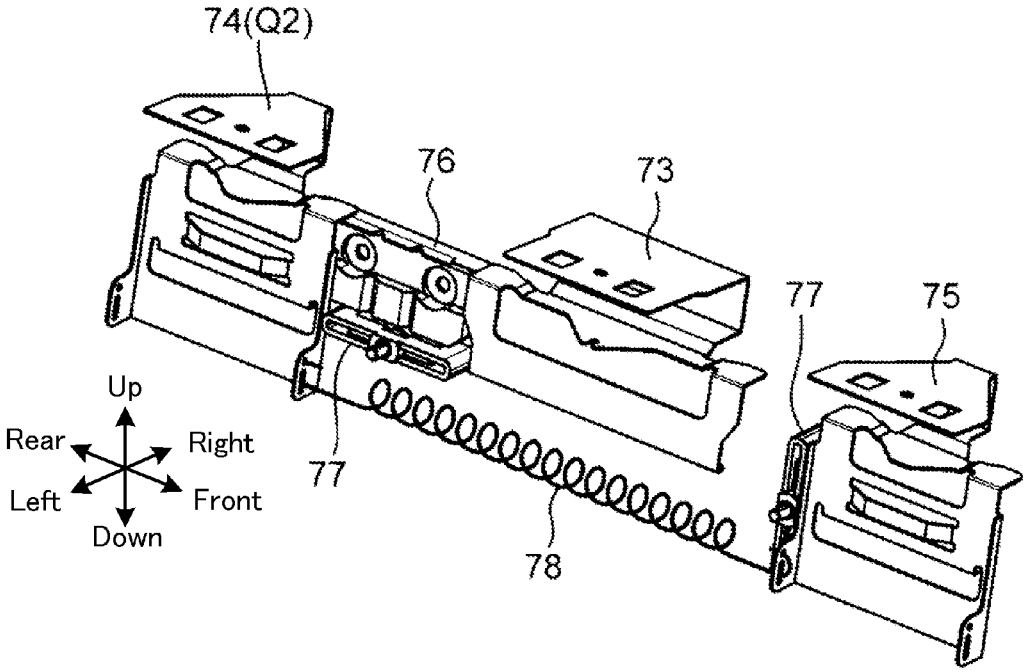
FIG. 14A is a perspective view illustrating an aspect in which a reference plate of a post-processing device according to an embodiment moves.
Figure 14B:
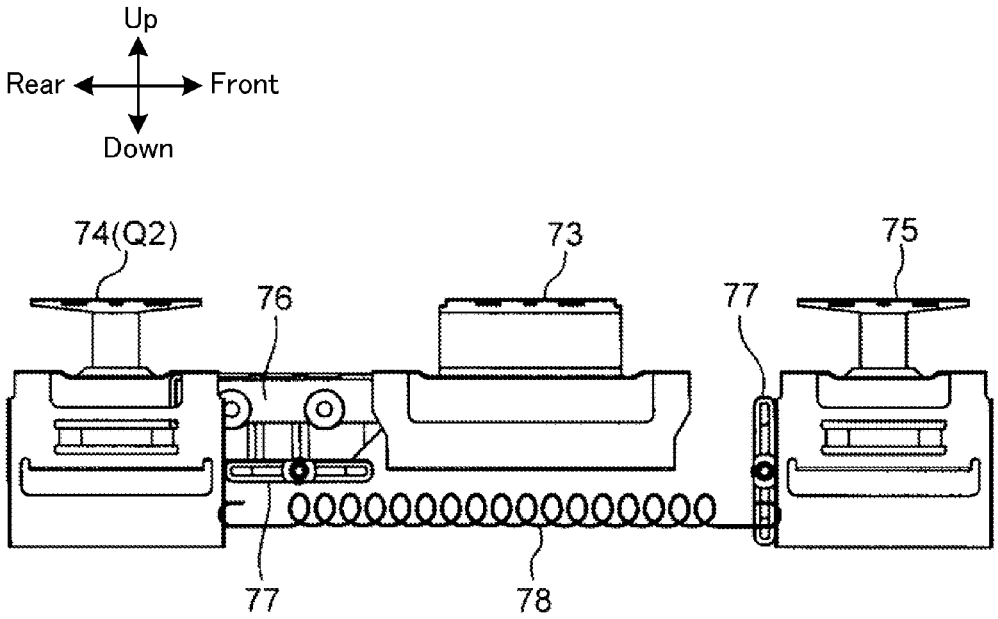
FIG. 14B is a side view illustrating an aspect in which a reference plate of a post-processing device according to an embodiment moves.

Moreover, when the engagement guide 76 moves frontward as the staple unit 71 is directed to the second staple position P2, the front side end surface of the engagement guide 76 abuts the upper link pressing part 772 of the link member 77 as illustrated in FIG. 12A and FIG. 12B. As a consequence, the link member 77 rotates around the link support point part 771 and the lower link pressing part 772 of the link member 77 presses the rear reference plate 74 against the urging force of the spring member 78 (an arrow D111 of FIG. 12A and an arrow D112 of FIG. 12B). Moreover, after the link member 77 rotates with the movement of the engagement guide 76 and passes the states illustrated in FIG. 13A and FIG. 13B, the engagement guide 76 is disposed between the rear reference plate 74 and the center reference plate 73 in the sheet width direction as illustrated in FIG. 14A and FIG. 14B. At this time, the staple unit 71 is disposed at the second staple position P2 (FIG. 6B). On the other hand, the rear reference plate 74 is pushed in rearmost by the link member 77. That is, the rear reference plate 74 is disposed at the second reference position Q2. The staple unit 71 positioned at the right side of the engagement guide 76 can perform the staple process on the plurality of sheets S without interfering with the rear reference plate 74 between the rear reference plate 74 and the center reference plate 73.

Furthermore, as described above, in the state in which the staple unit 71 has been disposed at the second staple position P2, the posture of the link member 77 is restrained by the engagement guide 76. In detail, since the lower surface portion of the engagement guide 76 abuts the link member 77, the link pressing parts 772 of the link member 77 are disposed along the horizontal direction, so that the rear reference plate 74 is held at the second reference position Q2. In addition, at this time, the protruding portion 763 (FIG. 9) of the engagement guide 76 is positioned at a space 77T (FIG. 10) between the pair of link pressing parts 772.

Figure 15A:
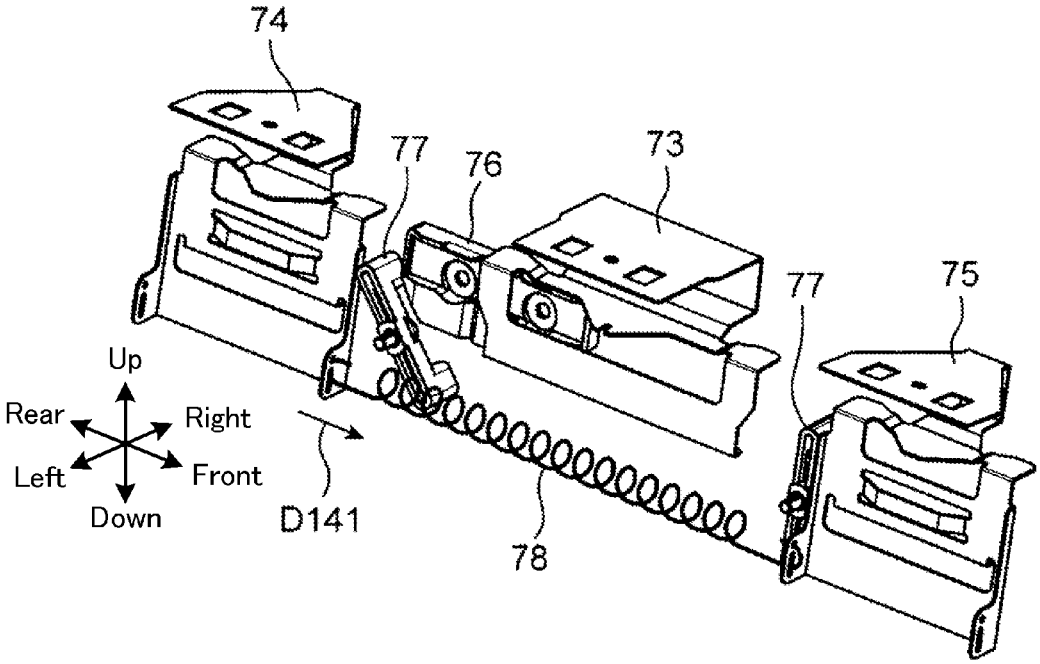
FIG. 15A is a perspective view illustrating an aspect in which a reference plate of a post-processing device according to an embodiment moves.
Figure 15B:
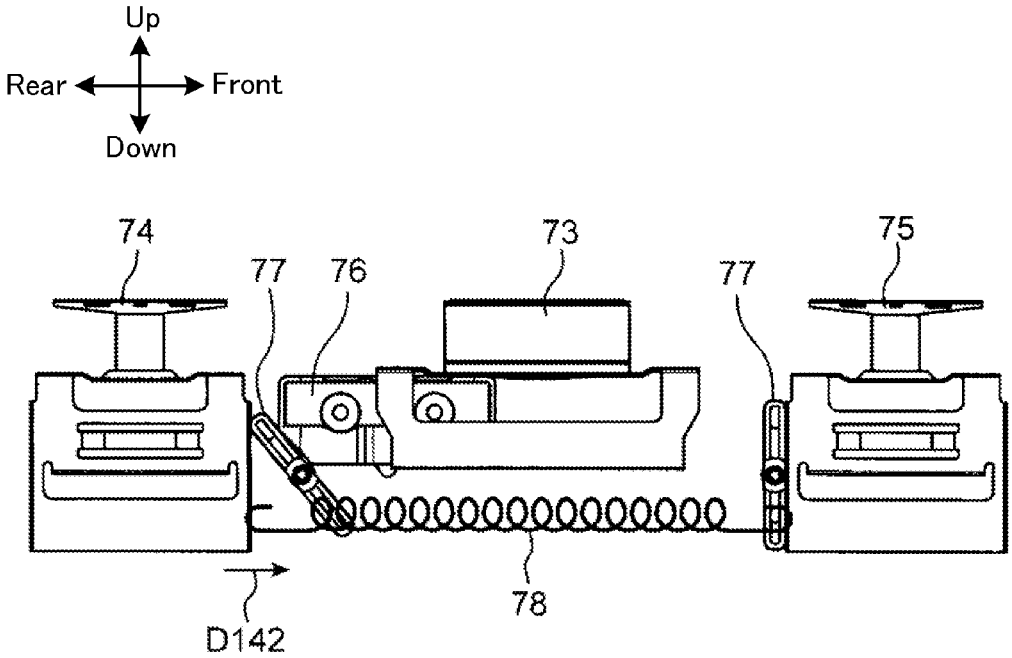
FIG. 15B is a side view illustrating an aspect in which a reference plate of a post-processing device according to an embodiment moves.
Figure 16A:
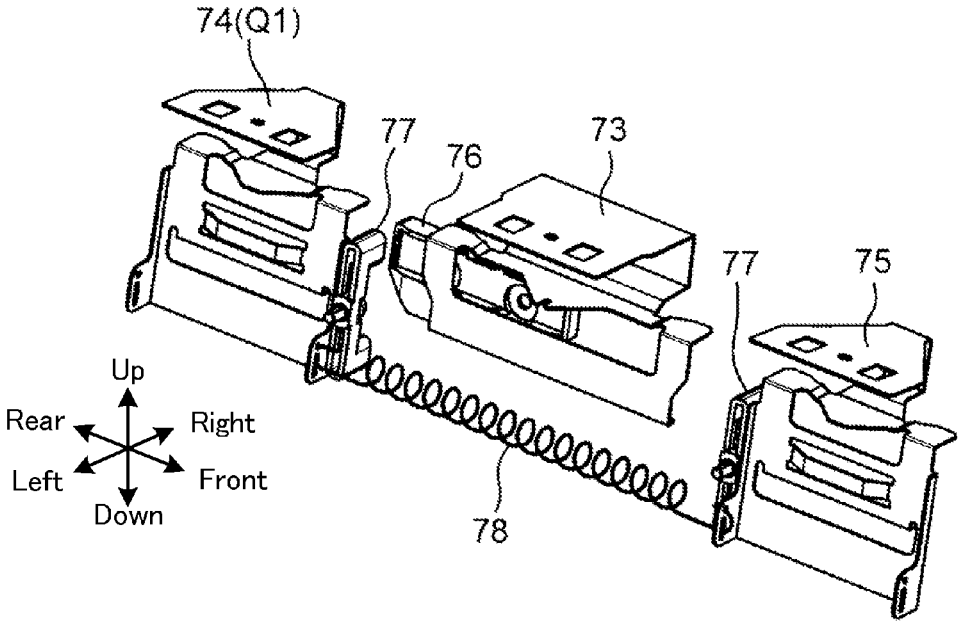
FIG. 16A is a perspective view illustrating an aspect in which a reference plate of a post-processing device according to an embodiment moves.
Figure 16B:
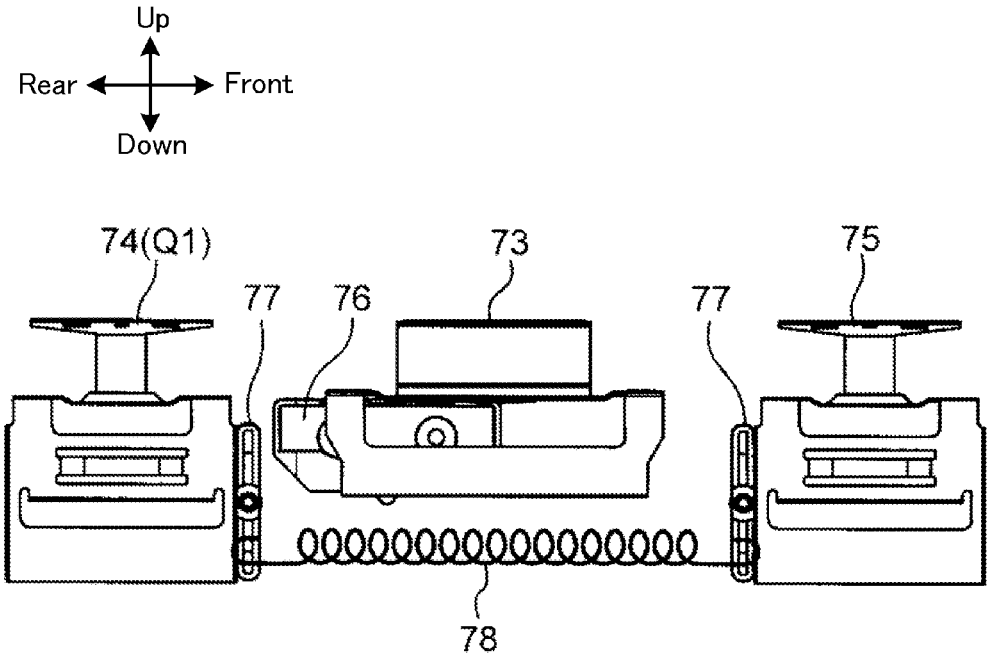
FIG. 16B is a side view illustrating an aspect in which a reference plate of a post-processing device according to an embodiment moves.

Moreover, when the staple unit 71 is directed from the second staple position P2 (FIG. 6B) to the fourth staple position P4 (FIG. 7A), the engagement guide 76 moves frontward. At this time, the protruding portion 763 of the engagement guide 76 presses the link pressing part 772, which is opposite to the rear reference plate 74, of the pair of link pressing parts 772 in the downward direction. As a consequence, the rotation of the link member 77 around the link pressing part 772 is promoted. Then, as illustrated in FIG. 15A and FIG. 15B, when the engagement guide 76 moves further frontward, the link member 77 rotates around the link pressing part 772. As a consequence, the pressing force applied to the rear reference plate 74 by the link member 77 is reduced, so that the rear reference plate 74 moves frontward by the urging force of the spring member 78 (an arrow D141 of FIG. 15A and an arrow D142 of FIG. 15B). Moreover, as illustrated in FIG. 16A and FIG. 16B, when the engagement guide 76 is detached from the link member 77, the rear reference plate 74 returns to the first reference position Q1 (FIG. 7A) by the urging force of the spring member 78. Furthermore, the link member 77 is disposed along the vertical direction again.

When the staple unit 71 moves from the fourth staple position P4 (FIG. 7A) to the second staple position P2 (FIG. 6B), the engagement guide 76 moves rearward from the state illustrated in FIG. 16A and FIG. 16B to the state illustrated in FIG. 11A and FIG. 11B in a reverse order. At this time, as illustrated in FIG. 15A and FIG. 15B, the rear end portion of the engagement guide 76 abuts the upper link pressing part 772 of the link member 77. Then, the link member 77 rotates around the link support point part 771, so that the upper link pressing part 772 of the link member 77 presses the rear reference plate 74 rearward against the urging force of the spring member 78 (an opposite direction of the arrow D141 of FIG. 15A). As a consequence, the rear reference plate 74 moves from the first reference position Q1 (FIG. 7A) to the second reference position Q2 (FIG. 6B).

In addition, when the engagement guide 76 moves further frontward from the state illustrated in FIG. 16A and FIG. 16B and the staple unit 71 moves from the fourth staple position P4 (FIG. 7A) to the third staple position P3 (FIG. 7B), the front reference plate 75 (FIG. 16A and FIG. 16B) slidingly moves in the front and rear direction and is disposed at the third reference position Q3 (FIG. 6B and FIG. 7B) and the fourth reference position Q4 (FIG. 7A) according to an operation similar to the above operation.

Furthermore, referring to FIG. 3A, FIG. 3B, and FIG. 8B, the rear reference plate 74 is rotatably supported to a shaft (not illustrated) disposed in the post-processing device body 500. In detail, the shaft extending in the sheet width direction (the front and rear direction) is provided with a rotatable shaft support member (not illustrated). Furthermore, the pressing portion 742C (FIG. 8) of the rear reference plate 74 is fixed to the shaft support member. As a consequence, the lower end side of the rear reference plate 74 is rotatable by employing the shaft as a support point. Moreover, the rear reference plate 74 slidably moves along the shaft in the front and rear direction. The support structure of the front reference plate 75 is also similar to that of the rear reference plate 74. In addition, FIG. 3A illustrates the state in which the rear reference plate 74 (the front reference plate 75) and the staple unit 71 are disposed at different positions in the front and rear direction crossing the paper surface, and FIG. 3B illustrates the state in which the rear reference plate 74 (the front reference plate 75) and the staple unit 71 are disposed at an overlapping position in the front and rear direction. In FIG. 3B, the rear reference plate 74 is pressed by the staple unit 71 and thus has a posture slightly rotated counterclockwise by employing the shaft as a support point, as compared with FIG. 3A.

As illustrated in FIG. 3A, when the staple unit 71 and the rear reference plate 74 are disposed at different positions in the sheet width direction, the sheet loading portion 742A (FIG. 8) of the rear reference plate 74 and an upper surface portion 711T (FIG. 3B) of the staple body part 711 facing the staple movable part 712 are set to be level with each other in order to stably align the front end portion of the sheet S. However, when the staple unit 71 and the rear reference plate 74 have moved in the sheet width direction as is, the sheet restraint part 742 of the rear reference plate easily interferes with the upper surface portion 711T of the staple body part 711. In the present embodiment, when the staple unit 71 and the rear reference plate 74 move in the sheet width direction and overlap each other, the upper end portion 764 of the engagement guide 76 slightly pushes up the sheet loading portion 742A of the rear reference plate 74 (FIG. 3B). As a consequence, the sheet restraint part 742 of the rear reference plate 74 is smoothly accommodated in the concave portion between the staple movable part 712 of the staple unit 71 and the upper surface portion 711T. In addition, as illustrated in FIG. 3B, the protruding piece 741T of the rear reference plate 74 abuts the lower surface portion of the engagement guide 76, so that the sheet restraint part 742 is prevented from being excessively pushed up.

As described above, in the staple processing device 52 according to the present embodiment, the interlocking mechanism 70 moves the rear reference plate 74 and the front reference plate 75 in the sheet width direction in interlock with the movement of the staple unit 71. Therefore, when the position of the staple unit 71 is decided, the positions of the rear reference plate 74 and the front reference plate 75 are also temporarily fixed until the staple position of the staple unit 71 is changed in correspondence to a next sheet bundle. As a consequence, when a plurality of sheets are sequentially carried in the staple tray 521, the rear reference plate 74 and the front reference plate 75 do not move, so that the alignment of sheets being loaded is prevented from being disordered by the movement of the rear reference plate 74 and the front reference plate 75.

In addition, even though the staple unit 71 is disposed at the third staple position P3 illustrated in FIG. 7B, when the size of the sheet S is small, since the staple process is performed on the corner part K2 (FIG. 4) of the sheet S, the sheet S needs to be shifted frontward (an arrow D72 direction of FIG. 7A). Consequently, in another embodiment different from the present embodiment, if the staple position for the corner part K2 can be disposed frontward to be larger than the front reference plate 75 with respect to all sizes of sheets S, only the sheets S are shifted, so that the front reference plate 75 needs not to slidingly move in the front and rear direction. However, in this case, the size of the staple processing device 52 in the front and rear direction is increased. On the other hand, according to the aforementioned embodiment, since the rear reference plate 74 and the front reference plate 75 are disposed at an inner side in the sheet width direction (the front and rear direction) if possible, a compact configuration of the staple processing device 52 is realized. Furthermore, in the present embodiment, when the posture of the staple unit 71 is obliquely changed (the third staple position P3), a stroke in which the staple unit 71 slidingly moves in the sheet width direction is short as compared with the aforementioned another embodiment. Therefore, the movement time of the staple unit 71 and the staple processing time for the sheet S are shortened.

The technology of the present disclosure is not limited to the aforementioned embodiment. The technology of the present disclosure, for example, can take the following modified embodiments.

(1) In the aforementioned embodiment, an example in which the staple unit 71 slidingly moves by the rotation of the shaft part 72S has been described. However, the technology of the present disclosure is not limited thereto. Instead of the shaft part 72S, by a wire, a belt mechanism, and the like stretched over pulleys, the staple unit 71 may also slidingly move.

(2) In the aforementioned embodiment, an example in which the spring member 78 is disposed between the rear reference plate 74 and the front reference plate 75 has been described. However, the technology of the present disclosure is not limited thereto. A unique urging member may also be provided to each of the rear reference plate 74 and the front reference plate 75.

What is claimed is:

1. A post-processing device comprising:

a housing;

a tray unit in which a plurality of sheets are carried toward a predetermined conveyance direction and on which the plurality of sheets are loaded;

a staple unit that is disposed to face ends of front end sides of the sheets in the conveyance direction, is movable along the ends in a sheet width direction perpendicular to the conveyance direction, and performs a staple process on the plurality of sheets;

a movement section that moves the staple unit in the sheet width direction;

a reference plate that abuts the ends of the plurality of sheets and aligns the plurality of sheets; and an interlocking mechanism that moves the reference plate in the sheet width direction in interlock with movement of the staple unit, wherein the staple unit is inclined by a predetermined angle with respect to the sheet width direction and can be disposed at a first staple position disposed to face a first corner part of the sheets formed by the ends and a second staple position that is an inner side from the first staple position in the sheet width direction and is disposed along the ends, the reference plate can be disposed at a first reference position that is an inner side from the first staple position in the sheet width direction and is disposed so as to overlap the second staple position and a second reference position that is disposed at an outer side from the first reference position and the second staple position in the sheet width direction, the staple unit includes a staple body part and a staple movable part provided to face the staple body part to form a concave portion for allowing entrance of the ends at the front end sides in the conveyance direction of the sheets between the staple movable part and the staple body part to perform a staple process in a vicinity of the ends of the sheets, and the interlocking mechanism disposes the reference plate at the first reference position when the staple unit is disposed at the first staple position, and allows the reference plate to pass through the concave portion provided in the staple unit to move the reference plate from the first reference position to the second reference position in interlock with movement of the staple unit from the first staple position to the second staple position.

2. The post-processing device of claim 1, wherein the interlocking mechanism moves the reference plate from the second reference position to the first reference position in interlock with movement of the staple unit from the second staple position to the first staple position.

3. The post-processing device of claim 2, wherein the interlocking mechanism comprises:

an urging member that urges the reference plate from the second reference position to the first reference position;

a rotating member that includes a support point part extending along the conveyance direction of the sheet and a pair of extending parts each extending in an opposite direction from the support point part in a direction crossing the conveyance direction, and is supported to the housing so as to be rotatable around the support point part adjacently to an inner side of the reference plate in the sheet width direction; and a pressing member fixed to the staple unit and brought into contact with the rotating member with the movement of the staple unit, wherein, when the pressing member abuts one of the extending parts of the rotating member with movement of the staple unit from the first staple position to the second staple position, the rotating member rotates around the support point part and a remaining one of the extending parts of the rotating member presses the reference plate against an urging force of the urging member, so that the reference plate moves from the first reference position to the second reference position.

4. The post-processing device of claim 3, wherein, in a state in which the staple unit is disposed at the second staple position, posture of the rotating member is restrained by the pressing member and the extending parts of the rotating member are disposed along a horizontal direction, so that the reference plate is held at the second reference position.

5. The post-processing device of claim 1, wherein the second reference position of the reference plate is disposed so as to overlap the first staple position of the staple unit.

6. The post-processing device of claim 1, wherein the staple unit is inclined by a predetermined angle with respect to the sheet width direction and can be disposed at a third staple position disposed to face a second corner part of the sheets formed by the ends at an opposite side of the first corner part and a fourth staple position that is formed between the second staple position and the third staple position and is disposed along the ends, and the interlocking mechanism moves the reference plate from the second reference position to the first reference position in interlock with movement of the staple unit from the second staple position to the fourth staple position.

7. The post-processing device of claim 6, wherein the interlocking mechanism moves the reference plate from the first reference position to the second reference position in interlock with movement of the staple unit from the fourth staple position to the second staple position.

8. The post-processing device of claim 7, wherein the interlocking mechanism comprises:

an urging member that urges the reference plate from the second reference position to the first reference position;

a rotating member that includes a support point part extending along the conveyance direction of the sheets and a pair of extending parts each extending in an opposite direction from the support point part in a direction crossing the conveyance direction, and is supported to the housing so as to be rotatable around the support point part adjacently to an inner side of the reference plate in the sheet width direction; and a pressing member fixed to the staple unit and brought into contact with the rotating member with the movement of the staple unit, wherein, when the pressing member abuts one of the extending parts of the rotating member with movement of the staple unit from the first staple position to the second staple position, the rotating member rotates around the support point part and a remaining one of the extending parts of the rotating member presses the reference plate against an urging force of the urging member, so that the reference plate moves from the first reference position to the second reference position, in a state in which the staple unit is disposed at the second staple position, posture of the rotating member is restrained by the pressing member and the extending parts of the rotating member are disposed along a horizontal direction, so that the reference plate is held at the second reference position, and when the pressing member is detached from the rotating member with movement of the staple unit from the second staple position to the fourth staple position, the rotating member rotates around the support point part by the urging force of the urging member, so that the reference plate moves from the second reference position to the first reference position.

9. The post-processing device of claim 8, wherein, when the pressing member abuts one of the extending parts of the rotating member with movement of the staple unit from the fourth staple position to the second staple position, the rotating member rotates around the support point part and the one of the extending parts of the rotating member presses the reference plate against the urging force of the urging member, so that the reference plate moves from the first reference position to the second reference position.

10. The post-processing device of claim 1, wherein the reference plate is disposed as a pair at an interval in the sheet width direction so as to interpose a center of the ends of the sheets in the sheet width direction.

11. An image forming apparatus comprising:

an image forming unit that forms an image on a sheet; and the post-processing device of claim 1.

* * * * *